US006142469A

United States Patent [19]

Nanba et al.

[11] Patent Number: 6,142,469

[45] Date of Patent: Nov. 7, 2000

[54] SHEET EJECTING MECHANISM WITH CONTACT MEMBER AND ADVANCE DESCENDING OF TRAY TO PREVENT DIRECT RETURN OF CONTACT MEMBER

[75] Inventors: Toyoaki Nanba, Higashiosaka; Jinichi Nagata, Osaka; Tomomi Tanaka, Yamatokoriyama; Takehiko Josako; Keiji Tanaka, both of Hiroshima, all of Japan

[73] Assignee: Sharp Kabushiki Kaisha, Osaka, Japan

[21] Appl. No.: 09/189,553

[22] Filed: Nov. 11, 1998

[30] Foreign Application Priority Data

Nov. 17, 1997 [JP] Japan ..... 9-315713

[51] Int. Cl.[7] ..... B65H 39/10

[52] U.S. Cl. ..... 271/288; 271/296; 271/298; 271/176; 271/288; 270/58.07; 270/58.14; 270/58.18; 270/58.08; 270/52.06; 270/52.03

[58] Field of Search ..... 271/296, 298, 271/176, 288; 270/58.07, 58.14, 58.18, 58.08, 52.06, 52.02

[56] References Cited

U.S. PATENT DOCUMENTS

| | | | |
|---|---|---|---|
| 3,948,510 | 4/1976 | Iwamoto et al. | 271/258 |
| 4,033,579 | 7/1977 | Stange et al. | 271/195 |
| 5,026,034 | 6/1991 | Russel et al. | 270/52 |
| 5,098,074 | 3/1992 | Mandel | 270/53 |
| 5,288,062 | 2/1994 | Rizzolo et al. | 270/53 |
| 5,328,169 | 7/1994 | Mandel | 271/290 |
| 5,478,062 | 12/1995 | Horiuchi et al. | 271/176 X |
| 5,823,529 | 10/1998 | Mandel et al. | 271/296 |

FOREIGN PATENT DOCUMENTS 03192065 8/1991 Japan .

*Primary Examiner*—Christopher P. Ellis
*Assistant Examiner*—Richard Ridley
*Attorney, Agent, or Firm*—Renner, Otto, Boisselle & Sklar LLP

[57] ABSTRACT

A sheet ejecting mechanism is provided with a sheet ejecting sensor which detects a sheet to be ejected onto an offset tray and an upper-surface position-regulating section which regulates the position of the upper surface of the sheets in accordance with the position of an arm which is in contact with the upper surface of the sheets on the offset tray. When the sheet ejecting sensor detects a sheet to be ejected, a CPU of the upper-surface position-regulating section turns on a solenoid so as to remove a contact between an arm and the upper surface of the sheets. Meanwhile, when the sheet ejecting sensor detects no sheet to be ejected, the CPU turns off the solenoid. With this operation, the arm is allowed to come into contact with the upper surface of the sheets so as to regulate the position of the upper surface of the sheets.

9 Claims, 13 Drawing Sheets

15
34
55
57
59
43
43a
43b

SHEET EJECTING MECHANISM WITH CONTACT MEMBER AND ADVANCE DESCENDING OF TRAY TO PREVENT DIRECT RETURN OF CONTACT MEMBER

FIELD OF THE INVENTION

The present invention relates to a sheet ejecting mechanism of an image forming apparatus or of a sheet postprocessing device which performs postprocessing for sheets ejected out of an image forming apparatus such as a copying machine.

BACKGROUND OF THE INVENTION

An image forming apparatus such as a copying machine has prevailed in recent years. Among image forming apparatuses, the digital copying machine has achieved a remarkable development. Consequently, sheet postprocessing devices have been developed in earnest for performing postprocessing operations including stapling, punching, and pasting (binding) on sheets ejected out of the copying machine.

The aforementioned sheet postprocessing device is usually provided with a tray for receiving sheets ejected after postprocessing has been performed. In many cases, this tray is arranged so as to ascend and descend in the sheet postprocessing device in response to the fluctuation in the number of ejected sheets. Every time an ascending/descending tray becomes full, the ascending/descending tray descends; therefore, it is possible to eject sheets favorably all the time without causing any defects in the stacking operation. Further, the ascending/descending tray descends so that a larger number of sheets can be stacked than a fixed tray. The following explanation describes a conventional sheet postprocessing device which is provided with the aforementioned ascending/descending tray.

For example, Japanese Laid-Open Patent Publication No.192065/1991 (Tokukaihei 3-192065) discloses a conventional sheet postprocessing device. As shown in FIG. 12, this sheet postprocessing device includes: ejecting rollers 102 and 103 for ejecting a sheet P to an ascending/descending tray 101; the ascending/descending tray 101 which receives the ejected sheet P and is capable of ascending and descending; a tray ascending/descending device 104; and a height detecting means 105.

The tray ascending/descending device 104 moves the ascending/descending tray 101 upward and downward in accordance with a control signal from a CPU (central processing unit, not shown) so as to keep the highest position of the ejected sheets P at a fixed height.

The height detecting means 105 is capable of detecting the highest position of the sheets P stacked on the ascending/descending tray 101 and is provided with detecting levers 106 and 107 which operate independently of each other with different lever lengths. The detecting lever 106, the short lever, is a lever for detecting the height of a small-size sheet such as B5 or A4 sheet. The detecting lever 107, the long lever, is a lever for detecting the height of a large-size sheet such as A3 sheet.

End portions 106*a* and 107*a* of the detecting levers 106 and 107 are installed on a pivoting axis 108 so that the levers make a pivoting movement. The pivoting axis 108 is provided in the vicinity of an ejecting outlet 109 of the ejecting rollers 102 and 103 in the same direction of rotating axes of the ejecting rollers 102 and 103. On the other hand, the other end portions 106*b* and 107*b* of the detecting levers 106 and 107 are arranged so as to form a contact portion which is always in contact with the upper surface of the sheets P stacked on the ascending/descending tray 101 by the weight of the lever or by pressing force of a spring (not shown). The pivoting axis 108 serves as a supporting point. Here, the detecting levers 106 and 107 are provided in the same direction as the axis with predetermined intervals.

In the vicinity of the pivoting axis 108, photo sensors 110 and 111, which are transmitting type, are provided in parallel with each other with respect to respective positions of levers in the direction of the pivoting axis 108. Further, light-shielding portions 112 and 113 are integrally fixed on the end portions 106*a* and 107*a* of the detecting levers 106 and 107 respectively. When the detecting levers 106 and 107 rotate by a predetermined angle while the sheet P is being ejected, the light-shielding portions 112 and 113 shield light on detecting sections 110*a* and 111*a* of the photo sensors 110 and 111. Therefore, the photo sensors 110 and 111 detect the light-shielding portions 112 and 113, which make a pivoting movement with the detecting levers 106 and 107, by the use of the detecting sections 110*a* and 111*a* so that it is possible to detect the position of the highest surface of the sheets P stacked on the ascending/descending tray 101. Successively, the photo sensors 110 and 111 send a detected result to the CPU.

With the aforementioned arrangement, a sheet P, which is subjected to postprocessing operations, including stapling and others in the sheet postprocessing device, is ejected onto the ascending/descending tray 101 through the ejecting rollers 102 and 103. Here, in the case when the sheet P is a small-size sheet, the leading portion of the sheet P slips between the ascending/descending tray 101 and the detecting lever 106 so as to move the end portion 106*b* of the detecting lever 106 upward. On the other hand, in the case when the sheet P is a large-size sheet, the leading portion of the sheet P initially slips between the ascending/descending tray 101 and the detecting lever 106 so as to move the end portion 106*b* of the detecting lever 106 upward. Then, the leading portion of the sheet P slips between the ascending/descending tray 101 and the detecting lever 107 so as to move the end portion 107*b* of the detecting lever 107 upward. Consequently, the detecting levers 106 and 107 respectively make a pivoting movement around the pivoting axis 108 in the direction of C (clockwise) as shown in FIG. 12. Additionally, the following description explains a case wherein the sheet P is a small-size sheet. Even in the case when the sheet size is large, the principle is the same as that of a small-size sheet.

As the ejecting operations are performed successively, the thickness of the sheets P gradually increases. When the detecting lever 106 makes a pivoting movement by a predetermined angle and the light-shielding portion 112 shields light on the detecting section 110*a* of the photo sensor 110, the photo sensor 110 recognizes that the upper surface of the sheets P stacked on the ascending/descending tray 101 has reached a predetermined height, and the photo sensor 101 sends a detection signal to the CPU. The CPU, which receives the detection signal, sends a signal to the tray ascending/descending device 104 so as to move the ascending/descending tray 101 downward by a predetermined amount, and then, the next sheet P can be ejected onto the ascending/descending tray 101.

Furthermore, when the ascending/descending tray 101 descends, the detecting lever 106 makes a pivoting movement in the direction of D (counterclockwise) as shown in FIG. 12 while being in contact with the upper surface of the sheets P by the weight of the lever or by pressing force of a spring (not shown). The pivoting axis 108 serves as a supporting point. At this time, since the light-shielding portion 112 is fixed on the detecting lever 106, the light-shielding portion 112 pivots in the same direction so as to remove the shield provided by the light-shielding portion 112 from the detecting section 110*a*. This operation allows the photo sensor 110 to detect the position of the upper surface of a succeeding sheet. The same operation is repeated in the following process. When the ascending/descending tray 101 reaches the lowest position, the tray of the sheets P has become full.

However, in the case when a very soft sheet (very thin sheet) is used, the aforementioned conventional arrangement causes inconveniences as follows:

Namely, as shown in FIG. 13, after having being ejected from the ejecting rollers 102 and 103, the leading portion of the very soft sheet cannot slip between the ascending/descending tray 101 and the detecting lever 106; therefore, it is not possible to move the detecting lever 106 upward. This is because the weight of the detecting lever 106 is too heavy load for the soft sheet P. As a result, as shown in FIG. 13, the sheet P is warped, thereby causing defects in stacking.

Moreover, in addition to the height detecting means 105 serving as a mechanical detecting means, an optical detecting means is also available for detecting the position of the upper surface of the sheets P. The optical detecting means, for example, receives reflected light by projecting light on the upper surface of the sheets P so as to detect the upper surface position of the sheets P in accordance with intensity of the received light. However, in order to detect the position correctly, it is further favorable to use the mechanical detecting means rather than the optical means. The reasons are as follows:

(1) Since the optical detecting means performs a detecting operation in accordance with light reflected from the surface of the sheet P which is stacked on the ascending/descending tray, the detecting operation is performed stably as long as the surface of the sheet P which reflects the light is always uniform. However, each sheet P on the ascending/descending tray differs in a degree of curling caused by passing through the fixing device and in hardness; therefore, the intensity of reflected light and the direction of reflection are not uniform in a practical operation. As a result, a detection using the optical detecting means is not reliable enough at this time.

(2) For example, in the case when light is projected on an image surface of the sheet P, which is black all over, most light is absorbed thereon. Consequently, it is not possible to obtain a correct quantity of reflected light.

(3) For example, in the case when the sheet P is a transparent sheet used for OHP (overhead projector) and others, projected light passes through the transparent sheet. Consequently, it is not possible to obtain reflected light.

SUMMARY OF THE INVENTION

The objective of the present invention is to provide a sheet ejecting mechanism which is capable of positively preventing defects in stacking caused by a material of a used sheet in a sheet postprocessing device.

In order to achieve the aforementioned objective, the sheet ejecting mechanism of the present invention is characterized in that it includes:

a sheet detecting section for detecting the existence of a sheet to be ejected onto an ascending/descending tray, a contact member which is separably contact with the upper surface of ejected sheets on the ascending/descending tray, and an upper-surface regulating section which moves the contact member so as to allow the contact member to be in contact with the upper surface of the ejected sheets in order to regulate the height of the upper surface of the ejected sheets in the case when no sheet to be ejected exists and which also moves the contact member so as to allow the contact member to separate from the upper surface of the ejected sheets in the case when a sheet to be ejected exists.

With the aforementioned arrangement, when the sheet detecting section detects a sheet to be ejected, the contact member separates from the upper surface of the ejected sheets, that is, the contact is removed between the contact member and the upper surface of the ejected sheets on the ascending/descending tray. Meanwhile, when the sheet detecting section detects no sheet to be ejected, the contact member moves so as to be in contact with the upper surface of the sheets so that the upper-surface position-regulating section regulates the height of the upper surface of the ejected sheets.

Namely, the upper-surface position-regulating section does not always allow the contact member to be in contact with the upper surface of the sheets. After the ejection of the sheet has been completed, the contact member is allowed to contact with the upper surface of the ejected sheets so as to regulate the height of the upper surface of the ejected sheets. Therefore, the sheet does not contact with the contact member while the sheet is being placed on the ascending/descending tray; consequently, warping found in the conventional mechanism, which is caused by a load of the contact member, does not occur on the sheet.

Therefore, with the aforementioned arrangement, even in the case when a very soft sheet is used, the sheet is ejected and stacked without warping; therefore, it is possible to prevent defects in stacking on the ascending/descending tray regardless of a material of the used sheet.

For a fuller understanding of the nature and advantages of the invention, reference should be made to the ensuing detailed description taken in conjunction with the accompanying drawings.

BRIEF DESCRIPTION OF THE DRAWINGS

FIG. 4(*b*) is an explanatory drawing which shows positions of the paper feeding gate, the reverse gate, and the switching gate when a sheet is transported to a reverse path.

FIG. 4(*c*) is an explanatory drawing which shows positions of the paper feeding gate, the reverse gate, and the switching gate when a sheet is transported from the reverse path to a detour path.

FIG. 4(*d*) is an explanatory drawing which shows positions of the paper feeding gate, the reverse gate, and the switching gate when a sheet is directly transported to the detour path without passing through the reverse path.

FIG. 5(*b*) is a sectional view which shows positions of the sheet supporting stand and the switching gate when sheets are stapled.

FIG. 5(*c*) is a sectional view which shows positions of the sheet supporting stand and the switching gate before the stapled sheets have been ejected.

FIG. 5(*d*) is a sectional view showing a state in which the sheets are ejected.

DESCRIPTION OF THE EMBODIMENTS

Referring to FIGS. 1 through 11, the following explanation describes one embodiment of the present invention.

Figure 2:
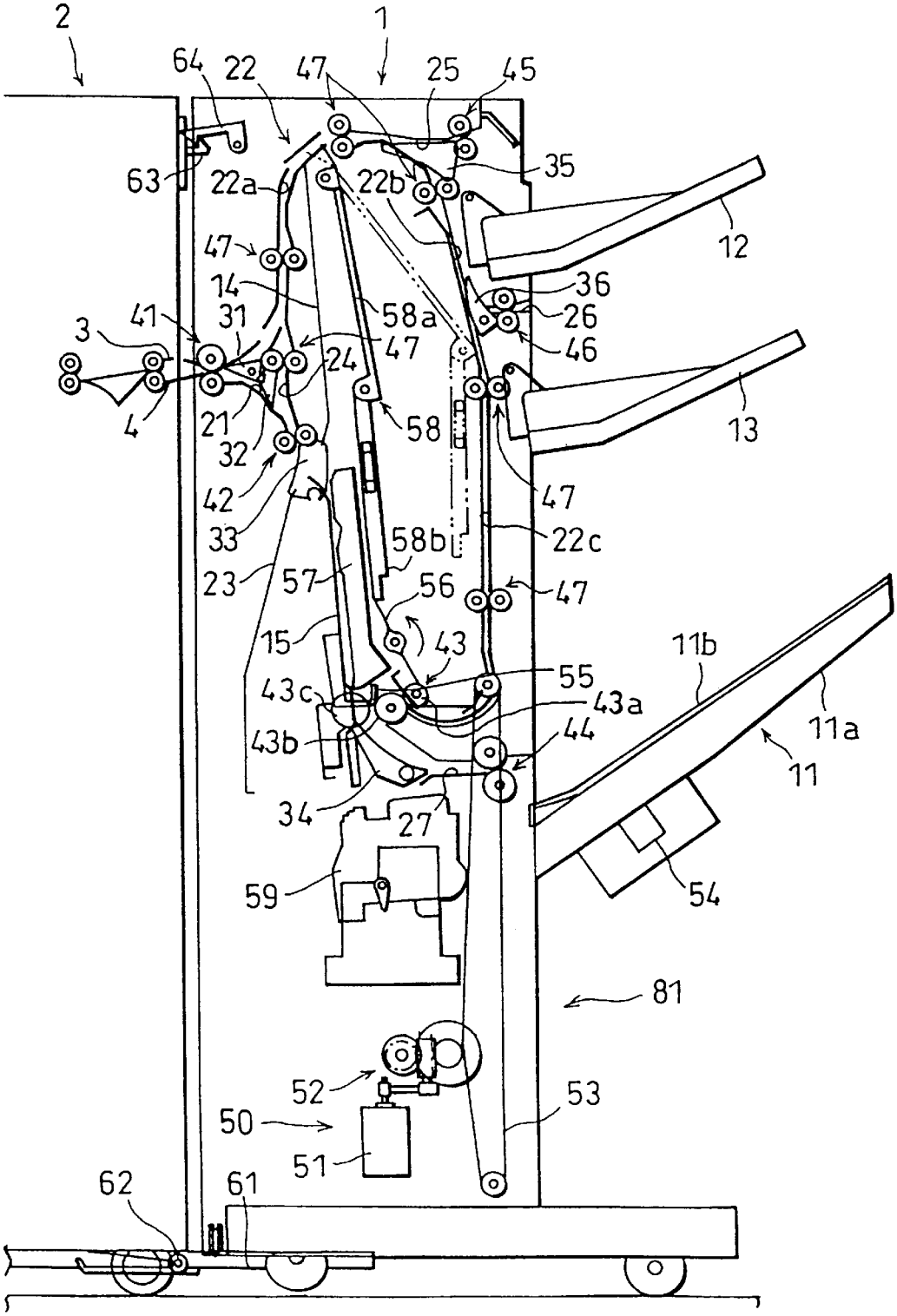
FIG. 2 is a sectional view which schematically shows the entire construction of the sheet postprocessing device.

As shown in FIG. 2, a sheet postprocessing device 1 of the present embodiment, which is installed on the side of a sheet ejecting outlet 3 of a copying machine 2 acting as an image forming apparatus, performs postprocessing operations including stapling and others and a sorting operation for sheets ejected out of the copying machine 2. The copying machine 2 includes, for example, a digital (color) copying machine which is capable of printing and faxing and also includes other commercial copying machines. Further, the sheet includes a paper and a transparent sheet used for OHP (overhead projector).

Additionally, among postprocessing operations which are conducted by the sheet postprocessing device 1 for sheets, there are punching and pasting besides stapling; however, this embodiment takes a case wherein a stapling is carried out as a postprocessing as an example of the present invention.

The sheet postprocessing device 1 is separably engaged with the copying machine 2 in the direction of ejecting sheets when the copying machine 2 or the sheet postprocessing device 1 has a paper jam, or when staples are replenished. When the sheet postprocessing device 1 is connected with the copying machine 2, a slanted rail 61, which is installed on the sheet postprocessing device 1, is set on a guide member 62 installed on the side of the copying machine 2. Therefore, it is possible to make two heights the same precisely: the height of the sheet ejection outlet 3 of the copying machine 2 and the height of a sheet feeding inlet 4 of the sheet postprocessing device 1.

The copying machine 2 is provided with a body-side hook 63 on the upper part to be connected with the sheet postprocessing device 1, and the sheet postprocessing device 1 is provided with a sheet-postprocessing device-side hook 64, which is capable of engaging with the body-side hook 63, on the upper part to be connected with the copying machine 2. Since these hooks are engaged with each other on the upper part, the copying machine 2 and the sheet postprocessing device 1 are connected in a more stable manner.

The sheet postprocessing device 1 is provided with, for example, an offset tray 11 which is capable of performing ascending, descending, and offset sorting operations, and serves as a tray that receives a large number of stapled copied sheets.

The driving force of an ascending/descending motor 51 is transmitted to the offset tray 11 through a driving force transmission system 52 composed of a gear and others and a driving wire 53 so that the offset tray 11 ascends and descends.

Moreover, the offset tray 11 has a double structure which consists of a lower offset tray reinforcing plate 11*a* and an upper offset tray plate 11*b*. The driving force of an offset motor 54 shifts the offset tray reinforcing plate 11*a* horizontally in a direction vertical to the sheet-transporting direction. In the same manner, the offset tray reinforcing plate 11*b* is shifted integrally with the offset tray reinforcing plate 11*a* horizontally in a direction vertical to the sheet-transporting direction.

With this operation, in the case when a plurality of sheets or a plurality of sets of sheets are ejected and offset sorting is performed, the offset tray plate 11*b* is shifted to the right and left alternately for each ejection so that ejected sheets are stacked in a manner in which each set of sheets is sorted to the right and left alternately. Therefore, especially in the case when a stapling operation is not performed on the set of sheets, it becomes quite easy to sort sheets.

Furthermore, an ascending/descending device 50 as an ascending/descending means for the offset tray 11 is constituted by the aforementioned ascending/descending motor 51, driving force transmission system 52, driving wire 53, and offset motor 54. Moreover, an explanation will be given later on the detail of a sheet ejecting section 81 which ejects sheets onto the offset tray 11.

Besides the offset tray 11, the sheet postprocessing device 1 is provided with two types of fixed tray; an upper fixed tray 12 and a lower fixed tray 13. Additionally, besides a copy mode, operation modes such as a fax mode and printer mode are available in the copying machine 2 of the present embodiment. For example, the upper fixed tray 12 is set as an ejection tray during a fax mode, and the lower fixed tray 13 is set as an ejection tray during a printer mode.

The sheet postprocessing device 1 is internally provided with a plurality of paths which are combined in various ways in accordance with a size of ejected sheets, whether stapling is performed or not, whether a reversed ejection is necessary or not, and a type of an ejection tray. With this arrangement, one transportation process is made by combining desired paths among the plurality of paths, necessary operations are carried out on sheets, and then the sheets are ejected.

The aforementioned plurality of paths are, specifically, composed of a direct path 21, a detour path 22, a reverse path 23, a connecting path 24, an upper fixed tray ejection path 25, a lower fixed tray ejection path 26, an offset tray ejection path 27, and a lower staple tray 15. A plurality of transporting rollers 47 are provided in each path so as to transport a sheet between paths.

The direct path 21 extends downward from the sheet feeding inlet 4 and, via a reverse roller 42, is connected to a gap portion which is provided between an upper staple tray 14 and a lower staple tray 15 which are installed vertically as mentioned below. Therefore, a sheet ejected from the copying machine 2 is transported through the direct path 21 and the reverse roller 42 to the lower staple tray 15.

The detour path 22 extends upward from the sheet feeding inlet 4, detours while curving above the upper portion of the upper staple tray 14, and after detouring, the detour path 22 travels downward in the vicinity of the side of trays of the sheet postprocessing device 1. And then, the detour path 22 curves again before reaching the upper portion of the offset tray 11, and connects to the lower portion of the lower staple tray 15. Further, the detour path 22, which extends from the sheet feeding inlet 4 to the lower portion of the lower staple tray 15, is divided into three parts; the detour paths 22*a*, 22*b*, and 22*c*. Additionally, the upper fixed tray ejection path 25 branches out from the contact portion between the detour paths 22*a* and 22*b*. The upper fixed tray ejection path 25 serves as a path for ejecting sheets to the upper fixed tray 12. On the other hand, the lower fixed tray ejection path 26 branches out from the contact portion between the detour paths 22*b* and 22*c*. The lower fixed tray ejection path 26 serves as a path for ejecting sheets onto the lower fixed tray 13.

In the vicinity of the reverse roller 42 installed at the lower portion of the direct path 21, the reverse path 23 extends almost vertically toward the copying machine 2 from the vicinity of the contact portion with a gap portion between the upper staple tray 14 and the lower staple tray 15. With this arrangement, in addition to the case when a sheet transported from the direct path 21 is transported to the lower staple tray 15, it is possible to transport a sheet to the reverse path 23. And then, the sheet introduced to the reverse path 23 is transported from the connecting path 24 to the detour path 22 by backward rotation of the reverse roller 42. Therefore, the reverse path 23 and connecting path 24 are used when a sheet is sent to the detour path 22 by temporarily switching it back.

The offset tray ejection path 27 extends downward from the lowest portion of the lower staple tray 15 and passes below the detour path 22. A sheet sent from the lowest potion of the lower staple tray 15 is ejected from the offset tray ejection path 27 onto the offset tray 11.

Further, the switching of each transporting path is performed by switching gates provided on junctions of paths and switching the directions of rotation of a transporting roller. The detail of these switching operations will be described later.

The lower staple tray 15 is a part of a staple tray which extends vertically for storing sets of stacked sheets temporarily before stapling. In the present embodiment, the lower staple tray 15 is used as a path which constitutes a part of a transporting path.

In other words, in the present embodiment, the staple tray is positioned almost vertically in the vicinity of the upper part of the sheet postprocessing device 1 in a state in which the staple tray is divided into the upper staple tray 14 and the lower staple tray 15. And a gap is provided between the upper staple tray 14 and the lower staple tray 15; therefore, as mentioned above, it is possible to transport a sheet from the direct path 21 to the lower staple tray 15 through the gap.

In the case when sheets are stapled in the sheet postprocessing device 1, sheets are stacked on the staple tray. In this case, a rear portion of a sheet is placed on a sheet supporting stand 55 and the lower edge of sheets is adjusted by the sheet supporting stand 55.

However, the sheets transported to the staple tray may not be adjusted sufficiently on the sheet supporting stand 55 due to static electricity and others. To prevent this problem, for each transport of a sheet, a rotation of a paddler 56 (counterclockwise in FIG. 2) applies transportation force working downward to a sheet so that the sheet is adjusted positively. The paddler 56 applies transportation force to the sheet by the use of a flexible wing portion which is made of an elastic material such as rubber. Further, the paddler 56 rotates once every time one sheet is transported to the staple tray. Moreover, an adjusting plate 57 holds the side of a set of sheets so that the side edges of sheets stacked on the sheet supporting stand 55 are properly adjusted.

Here, as mentioned above, the staple tray extends upward and downward and only one surface side of stacked sheets is supported in the area of the upper staple tray 14; therefore, the sheets may fall down to the opposite side of the staple tray.

To prevent the aforementioned problem, a paper guide section 58 is provided at least on the vicinity of the leading portion of the stacked sheets so that sheets are sandwiched and held between the staple tray and the paper guide section 58. The paper guide section 58 is, for example, constituted by two connecting plates 58*a* and 58*b*. When dealing with paper jam, it is possible to move the paper guide section 58 manually to a shelter position.

A stapler 59 is installed below the staple tray. When a predetermined number of sheets are stacked on the sheet supporting stand 55, the sheet supporting stand 55 descends to a position in which stapling is performed by the stapler 59, while holding the set of sheets. After the stapler 59 has stapled the set of sheets, the sheet supporting stand 55 ascends while holding sheets so that the set of sheets returns to the position of the staple tray. Successively, the sheet supporting stand 55 descends so that the set of sheets is ejected onto the offset tray 11 through the offset tray ejection path 27.

With the aforementioned arrangement, the sheet postprocessing device 1 controls the operations of gates and transporting rollers and switches transporting processes in accordance with an operation mode of the copying machine 2 and size of transported sheets. The following explanation describes operations of the sheet postprocessing device 1 at each operation mode of the copying machine 2.

(copy mode operation)

In the case when, during a copy mode of the copying machine 2, stapling is carried out for each set consisting of a predetermined number of sheets ejected out of the copying machine 2, a transporting process in the sheet postprocessing device 1 differs depending upon whether the sheet size is larger than letter size (A4 sideways) or not.

Firstly, the following explanation describes the case when the sheet size is not larger than letter size. Incidentally, in this case, in FIG. 3, the order of transporting process is: the direct path 21→the staple tray (only the lower staple tray 15)→the offset tray ejection path 27→the offset tray 11.

As shown in FIG. 2, a sheet ejected out of the sheet ejecting outlet 3 of the copying machine 2 is fed through the sheet feeding inlet 4 of the sheet postprocessing device 1 and a paper feeding roller 41 transports the sheet to the direct path 21 installed inside of the sheet postprocessing device 1. And then, the reverse roller 42 transports the sheet from the direct path 21 to the lower staple tray 15.

Additionally, the reverse roller 42 is capable of freely switching the rotations between the forward and backward rotations. The forward rotation of the reverse roller 42 transports a sheet from the direct path 21 to the lower staple tray 15 or to the reverse path 23. Further, when the reverse roller 42 rotates in the backward direction, the sheet is transported from the direct path 21 through the connecting path 24 to the detour path 22.

Here, in the vicinity of the paper feeding roller 41 and the reverse roller 42, at the start of the downstream side of the paper feeding roller 41, a paper feeding gate 31 is provided for switching between the transporting path of a sheet that has been fed to the direct path 21 and the detour path 22. Meanwhile, a reverse gate 32 is provided on the upstream side of the reverse roller 42 and switched in accordance with changes between the forward and backward rotations of the reverse roller 42. Further, at the start of the downstream side of the reverse roller 42, a switching gate 33 is provided for switching the transporting paths of a sheet between the lower staple tray 15 and the reverse path 23 during the forward rotation of the reverse roller 42.

Therefore, during the copy mode of the copying machine 2, in the case when sheets which are not larger than letter size are stapled, the paper feeding gate 31, the reverse gate 32, and the switching gate 33 are switched to the positions as shown in FIG. 4(*a*).

Figures 5A, 5B, 5C, 5D:
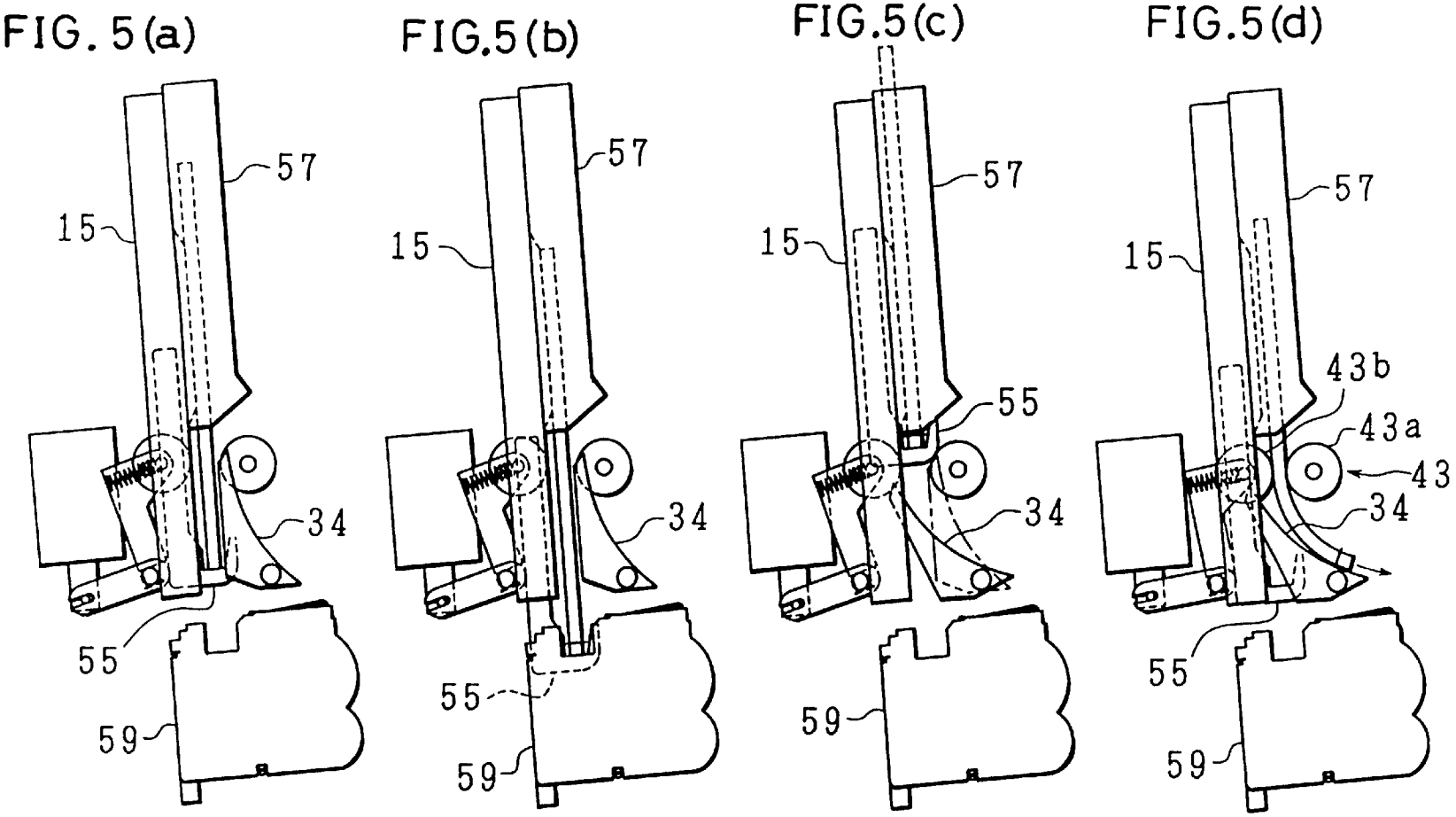
FIG. 5(*a*) is a sectional view which shows positions of a sheet supporting stand and the switching gate before sheets have been stapled.

The sheet transported through the direct path 21 is sent to a gap between the upper staple tray 14 and the lower staple tray 15 while being guided by the switching gate 33. As shown in FIG. 5(*a*), the sheet is stacked from the upper portion of the lower staple tray 15 onto the lower staple tray 15. In this case, the sheet size is smaller than letter size; therefore, the sheet is not placed out of the lower staple tray 15.

When a set of predetermined number of sheets is stacked on the sheet supporting stand 55, the sheet supporting stand 55 descends and the set of sheets is shifted to the stapler 59 and stapled as shown in FIG. 5(*b*). Incidentally, at this time, a switching gate 34, which is provided on the downstream side of the lower staple tray 15 for switching the transporting directions of the set of sheets to the offset tray 11 or the stapler 59, is switched to a position for sending the set of sheets to the stapler 59.

When stapling of the stapler 59 is completed, the sheet supporting stand 55 ascends, and as shown in FIG. 5(*c*), the set of sheets ascends back to the position higher than the switching gate 34. Afterwards, the switching gate 34 is switched to the position for ejecting sheets to the offset tray 11. In this state, as shown in FIG. 5(*d*), the sheet supporting stand 55 descends and the transporting roller 43, provided on the upstream side of the switching gate 34, rotates sheets while pressing so that the set of sheets is sent to the offset tray ejection path 27. Successively, a sheet ejecting roller 44 ejects the set of sheets through the offset tray ejection path 27 to the offset tray 11.

Further, the transporting roller 43 is constituted by a driving roller 43*a* and two driven rollers 43*b* and 43*c*. In the case when the set of sheets is sent to the offset tray ejection path 27, the driving roller 43*a* and the driven roller 43*b* are used. On the other hand, the driven roller 43*c* and the driving roller 43*a* are used simultaneously in the case when sheets transported from the detour path 22 are sent to the staple tray. Further, the driven roller 43*b* can be separably in contact with the driving roller 43*a*. When a set of sheets is sent to the stapler 59, the driven roller 43*b* shifts to a shelter position so that it is possible to prevent the driven roller 43*b* from interfering the shifting of sheets.

The following explanation discusses the case when a sheet size is larger than letter size. Incidentally, in this case, in FIG. 3, the order of transporting process is: the direct path 21→the reverse path 23→the connecting path 24→the detour path 22→the staple tray (including the upper staple tray 14 and the lower staple tray 15)→the offset tray ejection path 27→the offset tray 11.

As shown in FIG. 2, a sheet fed from the copying machine 2 is firstly sent to the direct path 21 and then to the reverse path 23. At this time, the paper feeding gate 31, the reverse gate 32, and the switching gate 33 are switched to the positions as shown in FIG. 4(*b*).

With this arrangement, when the sheet is sent to the reverse path 23 and the end edge of the sheet passes through the reverse gate 32, as shown in FIG. 4(*c*), the reverse gate 32 is switched to the position for sending a sheet from the reverse path 23 to the detour path 22, and the rotating direction of the reverse roller 42 is switched to the opposite at the same time. Therefore, a sheet fed from the copying machine 2 is temporarily switched back at the reverse path 23 and then sent through the connecting path 24 to the detour path 22.

Furthermore, in the present embodiment, the rear end of a sheet being ejected from the copying machine 2 is defined as the rear portion of a sheet. In the same manner, the leading end of a sheet being ejected from the copying machine 2 is defined as the leading portion of a sheet. Therefore, a sheet which is switched back at the reverse path 23 is transported to the detour path 22 in a state in which the rear portion of the sheet travels ahead.

The following is the reason why a sheet is switched back at the reverse path 23 before being transported to the detour path 22.

In the case when the copying machine 2 is in the copy mode, the copying machine 2 ejects sheets from the last page. Therefore, in the case when sheets are stapled, it is necessary to stack sheets with their face up on the staple tray, that is, to stack sheets with their image-bearing surface always facing up in succession.

However, in the sheet postprocessing device 1 of the present embodiment, if the sheets ejected from the copying machine 2 are stacked on the staple tray directly through the detour path 22, the sheets are stacked with their face down. Therefore, in the sheet postprocessing device 1, a sheet is temporarily switched back at the reverse path 23 before being transported to the detour path 22 so as to be stacked on the staple tray with their face up.

A sheet, which has been transported to the detour path 22, passes through the whole course of the detour path 22 and is sent to the staple tray from the lowest portion of the lower staple tray 15 by the transporting roller 43. Here, the driving roller 43*a* and the driven roller 43*c* are used as the transporting rollers 43. At this time, since the sheet size is larger than letter size, the sheet is stacked in a state in which both the upper staple tray 14 and the lower staple tray 15 support the sheets.

Namely, in the case when the sheet size exceeds letter size, if the sheet is sent to the staple tray by means of the direct path 21, the sheet is placed out of the lower staple tray 15 since the sheet size is too large. Consequently, a transport jam occurs in the direct path 21; therefore, in this case, the detour path 22 is used for sending a sheet to the staple tray.

Since the process after sheets have been stacked on the staple tray is the same as the case when the sheet size is smaller than letter size, the explanation thereof is omitted.

Figure 3:
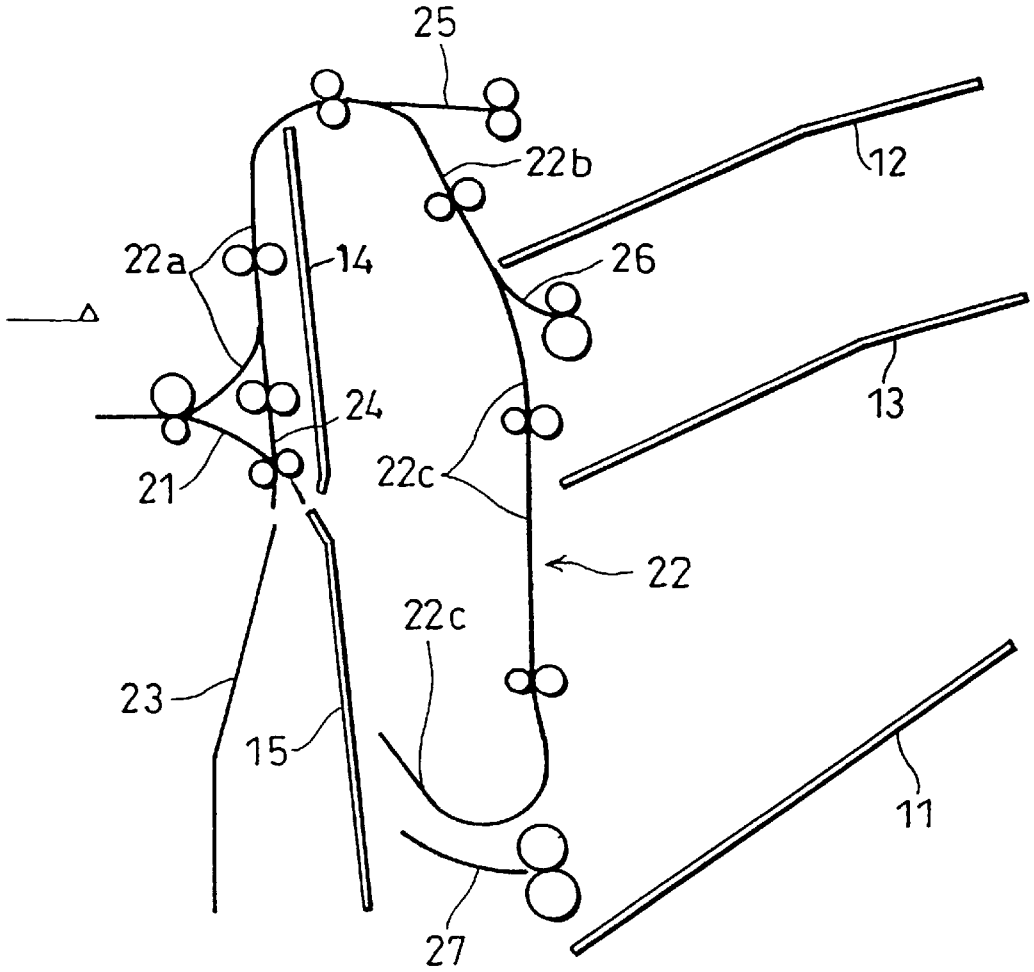
FIG. 3 is an explanatory drawing showing a path which a sheet passes through before a sheet has been ejected onto each tray.
Figure 4A:
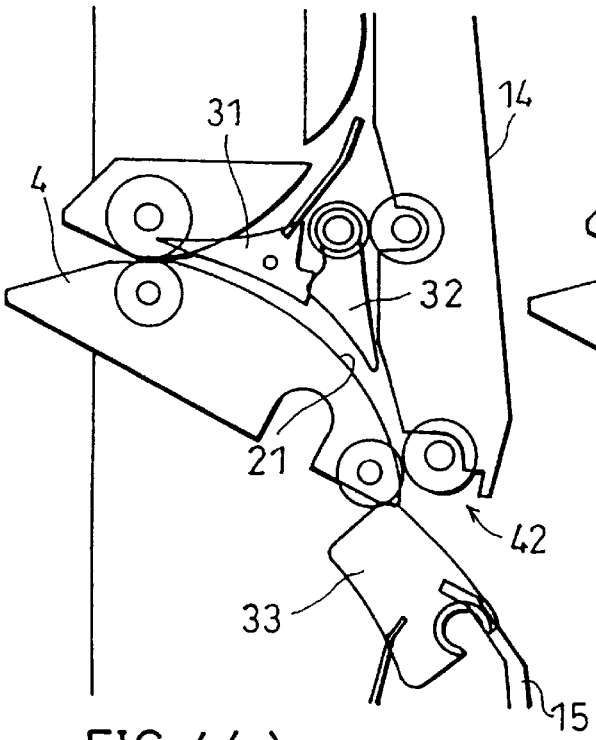
FIG. 4(*a*) is an explanatory drawing which shows positions of a paper feeding gate, a reverse gate, and a switching gate when a sheet is directly transported to a lower staple tray.
Figure 4B:
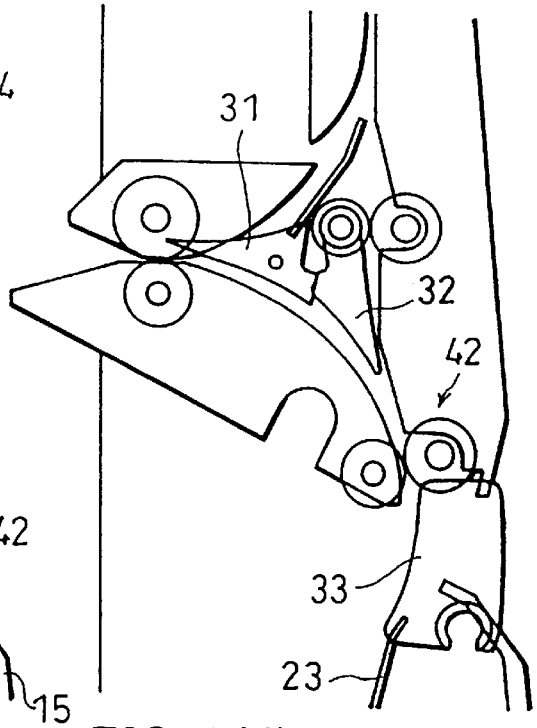
Figure 4C:
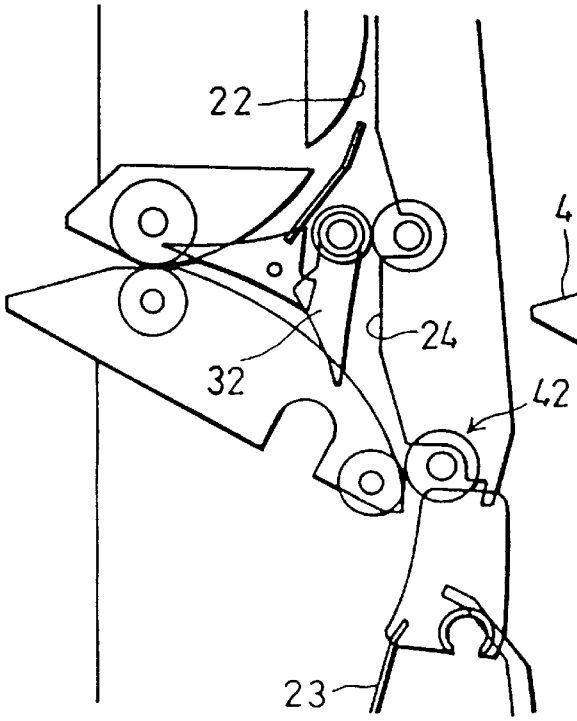
Figure 4D:
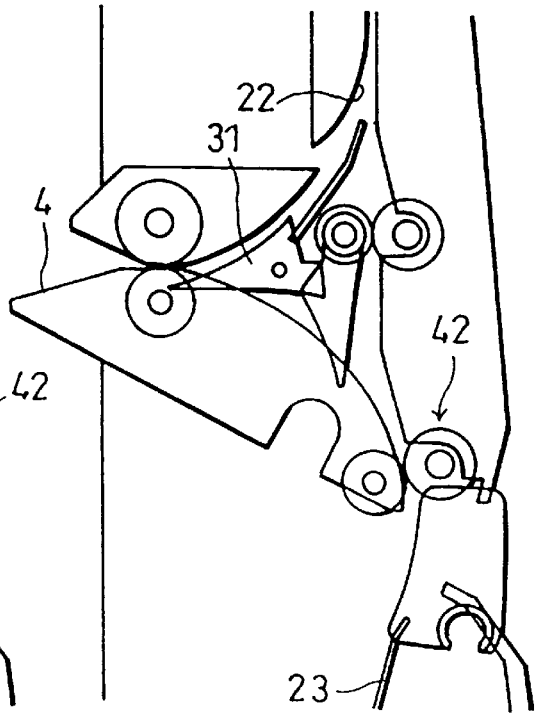

Further, during a copy mode without using the stapling process, regardless of sheet size, the order of transporting process is: the direct path 21→the staple tray (only the lower staple tray 15)→the offset tray ejection path 27 the offset tray 11 in FIG. 3.

In other words, in this case, a sheet transported from the copying machine 2 does not have to be stacked on the lower staple tray 15, and sheets are ejected onto the offset tray 11 one by one. Therefore, at this time, the sheet supporting stand 55 keeps a low position, and the switching gate 34 keeps a position for ejecting sheets onto the offset tray 11.

(fax mode and printer mode operations)

As described above, sheets, which are to be ejected from the copying machine 2, are ejected onto the upper fixed tray 12 during a fax mode and are ejected onto the lower fixed tray 13 during a printer mode. Note that, sheets are normally ejected with their face up from the last page during a copy mode, while sheets are ejected from the first page during the fax mode and the printer mode.

For this reason, if sheets are ejected with their face up in the same manner as the copy mode, the sheets are placed in the opposite order after ejection in the fax mode and the printer mode. Therefore, sheets are switched back once before ejection so as to be placed with their face down on the offset tray 11.

That is, in FIG. 3, the order of the transporting process during the fax mode is: the direct path 21→the reverse path 23→the connecting path 24→the detour path 22*a*→the upper fixed tray ejection path 25→the upper fixed tray 12. On the other hand, in FIG. 3, the transporting process during the printer mode is: the direct path 21→the reverse path 23→the connecting path 24→the detour path 22*a*→the detour path 22*b*→the lower fixed tray ejection path 26→the lower fixed tray 13.

With this arrangement, during the fax mode and the printer mode, a sheet which has been fed from the copying machine 2 is sent to the reverse path 23 once, and after having been switched back, the sheet is sent to the detour path 22. The operation of the sheet postprocessing device 1 at this time is the same as the case when sheets not smaller than letter size are stapled during the copy mode.

With this arrangement, as shown in FIG. 2, the sheet sent to the detour path 22 is ejected to the upper fixed tray 12 or the lower fixed tray 13 en route during the process of the detour path 22. Namely, during the fax mode, by switching paper ejecting gate 35, a sheet transported through the detour path 22 is ejected through the upper fixed tray ejection path 25 to the upper fixed tray 12 by means of paper ejecting roller 45. During the printer mode, by switching paper ejecting gate 36, a sheet is ejected through the lower fixed tray ejection path 26 to the lower fixed tray 13 by means of paper ejecting roller 46.

Additionally, in the case when the copying machine 2 is provided with a large capacity of memory so that it is possible to store all image data in the memory and to print and eject from the last page, it is not necessary to switch back a sheet. Therefore, it is possible to send a sheet fed from the copying machine 2 through the sheet feeding inlet 4 directly to the detour path 22 without using the reverse path 23, and then to eject the sheet to the upper fixed tray 12 or the lower fixed tray 13. In this case, the paper feeding gate 31 is switched to the position as shown in the FIG. 4(*d*).

Moreover, in the case when stapling is performed during the fax mode or the printer mode, the transporting process of the sheet postprocessing device 1 differs depending upon whether the copying machine 2 is provided with enough memory or not.

In the case when the copying machine 2 is provided with enough memory, it is possible to print and eject sheets from the last page in the same manner as the copy mode. Therefore, the transporting process of the sheet postprocessing device 1 is the same as that of the copy mode. Namely, when a sheet is not larger than letter size, the order of the transporting process is: the direct path 21→the staple tray (only the lower staple tray 15)→the offset tray ejection path 27→the offset tray 11. Meanwhile, when a sheet is not smaller than letter size, the order of the transporting process is: the direct path 21→the reverse path 23→the connecting path 24→the detour path 22→the staple tray (including the upper staple tray 14 and the lower staple tray 15)→the offset tray ejection path 27→the offset tray 11. Further, switching operations for each roller and gate are the same as the copy mode.

On the other hand, in the case when the copying machine 2 is not provided with enough memory, sheets are printed and ejected from the first page. Therefore, it is necessary to stack sheets with their face down on the staple tray. At this time, if the direct path 21 is used for sending sheets directly to the lower staple tray 15, it is not possible to stack sheets with their face down. In this case, regardless of sheet size, the detour path 22 is used for transporting the sheets to the staple tray.

Namely, in FIG. 3, th e order of the transporting process is: the detour path 22→the staple tray (only the lower staple tray 15, or including the upper staple tray 14 and the lower staple tray 15)→the offset tray ejection path 27→the offset tray 11.

However, even if the copying machine 2 is provided with enough memory, image data to be stored in the memory may exceed the capacity of memory. In this case, the copying machine 2 ejects sheets from the first page; therefore, the sheet postprocessing device 1 performs the same operation as in the case when the copying machine 2 is not provided with enough memory.

The above explanation describes a transportation process for each operation mode of the copying machine 2 in the sheet postprocessing device 1 of the present embodiment.

Referring to FIGS. 1, and 6 through 11, the following explanation describes the detail of the aforementioned sheet ejecting section 81 of the sheet postprocessing device 1.

Figure 1:
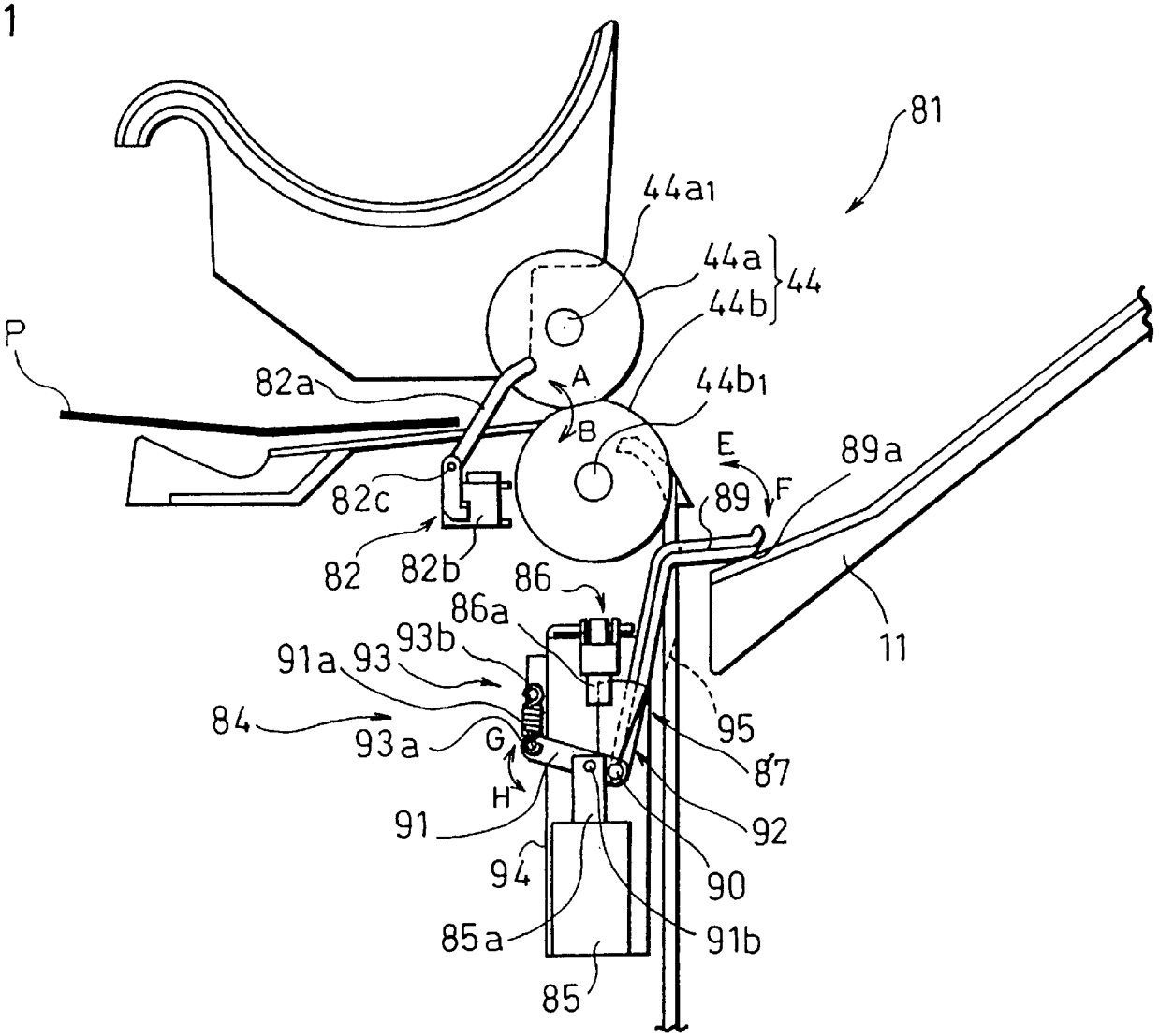
FIG. 1 is a sectional view which shows a schematic construction of a sheet ejecting section of a sheet postprocessing device in accordance with the present invention, and also shows a state of the sheet ejecting section before a sheet has been ejected onto an ascending/descending tray.

As shown in FIG. 1, the sheet ejecting section 81 is provided with a paper ejecting sensor 82 (sheet detecting means) and an upper-surface position-regulating section 84 (upper-surface position-detecting means) in addition to the offset tray 11, the paper ejecting roller 44 constituted by an upper paper ejecting roller 44*a* and a lower paper ejecting roller 44*b*, and the ascending/descending device 50 (shown in FIG. 2).

The paper ejecting sensor 82 is provided for detecting the existence of the sheet P which is to be ejected to the offset tray 11 acting as an ascending/descending tray. The paper ejecting sensor 82 is installed on the upstream side of the paper ejecting roller 44 with respect to the ejecting direction of the sheet P.

The paper ejecting sensor 82 is constituted by an arm 82*a* and a sensor body 82*b*. One end of the arm 82*a* is installed on a pivot supporting point 82*c* of the sensor body 82*b*. The axis direction of the pivot supporting point 82*c* is arranged so as to be the same as direction of the rotating axes 44*a*$_1$ and 44*b*$_1$. Therefore, the arm 82*a* is capable of making a pivoting movement in the direction of A–B as shown in FIG. 1 with the pivot supporting point 82*c* serving as an axis.

Furthermore, the arm 82*a* is always pressed by a spring (not shown) in the direction of A of FIG. 1; however, even if the sheet P which is to be ejected is very soft, the transportation force of the sheet allows the arm 82*a* to pivot positively in the direction of B.

With this arrangement, the arm 82*a* is initially held at the position where the arm 82*a* is in contact with the transported sheet P. After coming into contact with the sheet P, the arm 82*a* pivots around the pivot supporting point 82*c* serving as an axis in the direction of B by the transportation force of the sheet P. Further, after the sheet P has passed through the position of the arm 82*a*, that is, after the rear portion of the sheet P has passed through the end of the arm 82*a* which is opposite to the pivoting end thereof, the arm 82*a* pivots in the direction of A by the pressing force of the spring and returns to the sheet detecting position so as to positively detect the newly transported sheet P.

The sensor body 82*b* detects whether the ejected sheet exists or not based on a state of a movement of the arm 82*a*, and sends the resulting detection signal to a CPU 83 of the upper-surface position-regulating section 84 which is mentioned below. In other words, when the arm 82*a* moves in the direction B, the sensor body 82*b* recognizes the existence of the sheet P and sends to the CPU 83 a detection signal indicating the existence of the sheet P; meanwhile, when the arm 82*a* pivots in the direction of A, the sensor body 82*b* recognizes the passage of the sheet P and sends to the CPU 83 a detection signal indicating no sheet exists.

The following explanation describes the upper-surface position-regulating section 84.

The upper-surface position-regulating section 84 is constituted by the CPU 83 (controlling means, shown in FIG. 6), a solenoid 85 (position changing means), an upper limit sensor 86, and a full-detecting actuator 87. In accordance with the position of an arm 89, mentioned below, of the full-detecting actuator 87, the upper-surface position-regulating section 84 regulates the position of the upper surface of sheets which are placed on the offset tray 11.

Figure 6:
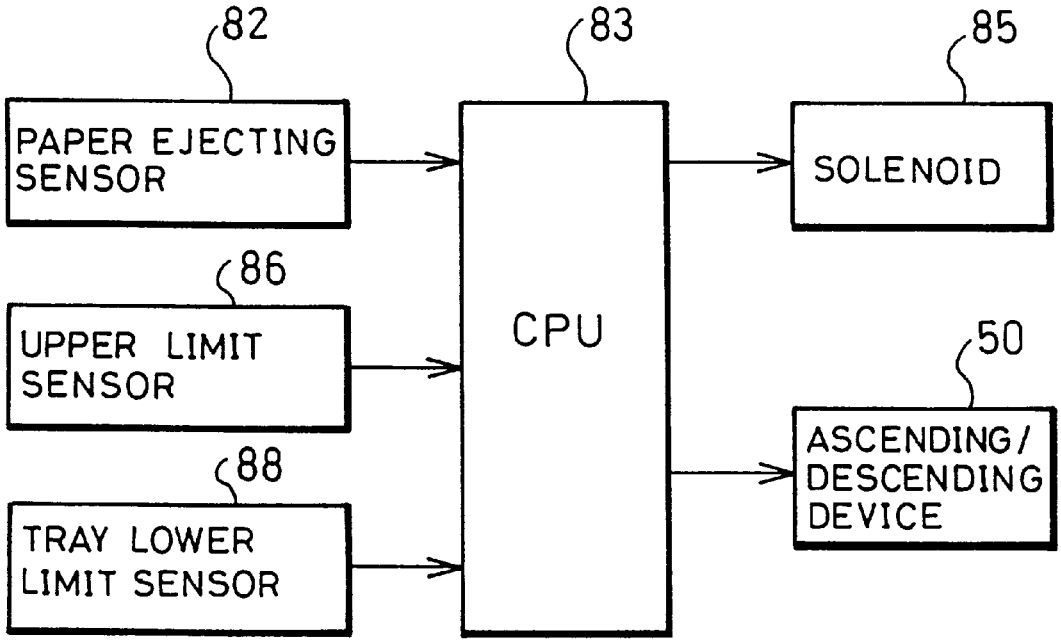
FIG. 6 is a block diagram showing a flow of each signal in the sheet ejecting section.

As shown in FIG. 6, the CPU 83 sends a control signal to the solenoid 85, mentioned below, of the upper-surface position-regulating section 84 and the ascending/descending device 50 in accordance with a detection signal from the paper ejecting sensor 82. In other words, when the detection signal indicates the existence of a sheet, the CPU 83 sends a signal so as to turn on the solenoid 85 and sends a signal to the ascending/descending device 50 so that the offset tray 11 descends by a predetermined amount. On the other hand, when the detection signal indicates no sheet, the CPU 83 sends a signal to turn off the solenoid 85 after a predetermined amount of time has elapsed.

The solenoid 85 turns itself on/off in accordance with the control signal from the CPU 83 so as to change the position of a solenoid top portion 85*a*. Specifically, when the control signal turns on the solenoid 85, the solenoid top portion 85*a* is pulled to the inside of the solenoid 85; meanwhile, when the control signal turns off the solenoid 85, the solenoid top portion 85*a* is pushed to the outside of the solenoid 85.

The full-detecting actuator 87 is constituted by the arm 89 (contact member), a pivoting axis member 90, a solenoid connecting member 91, and a light-shielding member 92.

One end of the arm 89 is a contact portion 89*a* which is in contact with the upper surface of the sheets P placed on the offset tray 11. Meanwhile, the other end of the arm 89, an end portion 89*b* (shown in FIG. 8), is fixed on the pivoting axis member 90. The pivoting axis member 90 is provided in the same direction as rotating axes 44*a*$_1$ and 44*b*$_1$ of the paper ejecting roller 44 and acts as a pivot supporting point of the arm 89.

One end of the solenoid connecting member 91 is fixed on the pivoting axis member 90 in a state in which the solenoid connecting member 91 is virtually vertical to the arm 89. The other end of the solenoid connecting member 91 is provided with an engaging convex member 91*a* which is engaged with an end portion 93*a* of a spring 93. Further, the solenoid connecting member 91 is provided with an axis member 91*b* on which the solenoid connecting member 91 and the solenoid top portion 85*a* are installed, in the vicinity of the pivoting axis member 90.

Figure 9:
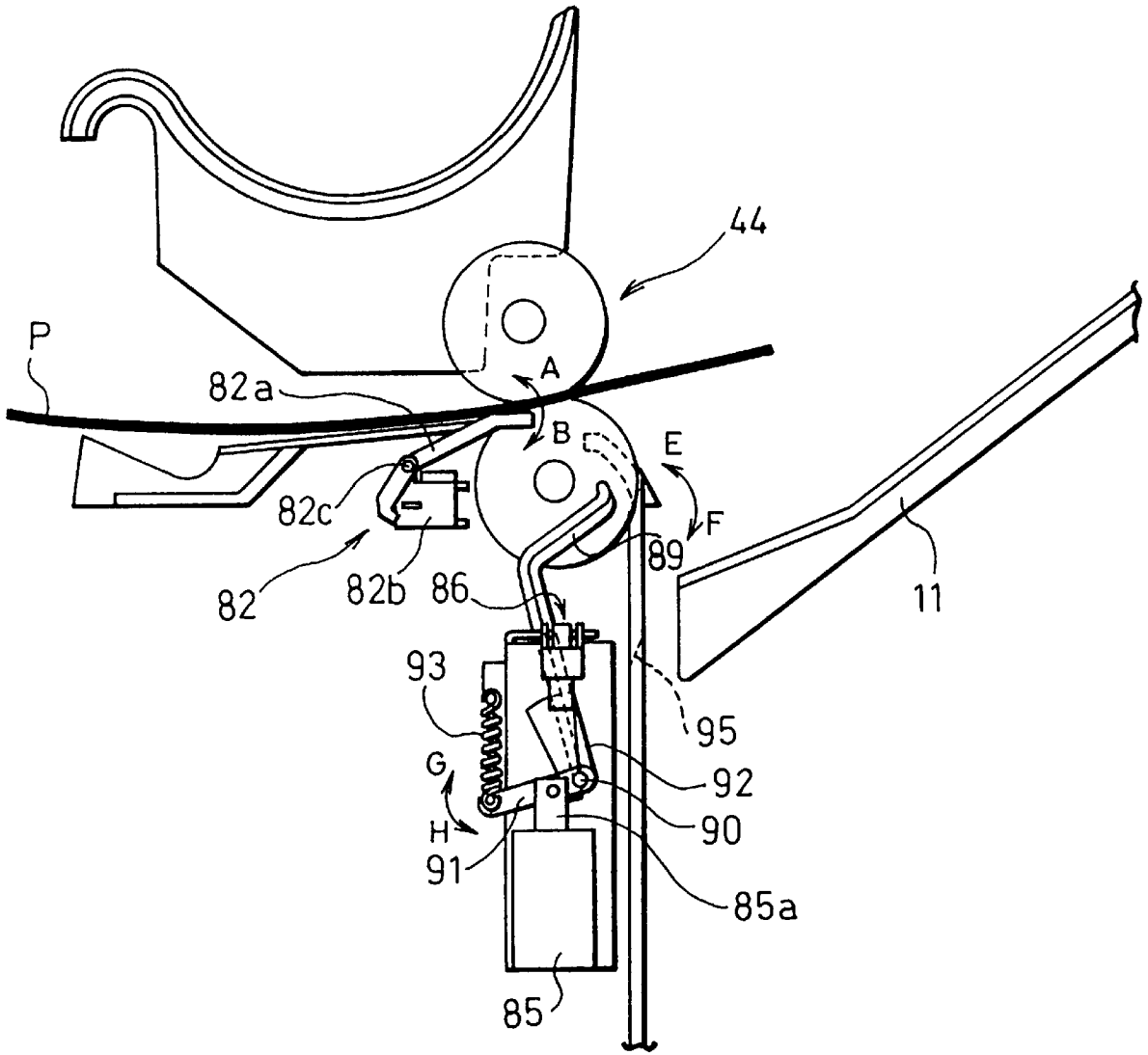
FIG. 9 is a sectional view which shows positions of an arm of a paper ejecting sensor and an arm of a full-detecting actuator when a sheet is being ejected out of paper ejecting rollers.

With this arrangement, in accordance with a change of position of the solenoid top portion 85*a* based on a control signal from the CPU 83, the solenoid connecting member 91 is capable of moving in the direction of G–H of FIG. 9 around the pivoting axis member 90 acting as a supporting point. At the same time, the arm 89, fixed on the pivoting axis member 90, is also capable of moving in the direction of E-F of FIG. 9 around the pivoting axis member 90 acting as a supporting point.

The end portion 93*b* of the spring 93, which is an opposite end of the end portion 93*a*, is attached to a box-shaped body 94 which supports the solenoid 85, the upper limit sensor 86, and the full-detecting actuator 87; therefore, the arm 89 is always pressed in the direction of F through the solenoid connecting member 91 and the pivoting axis member 90.

On the inside surface of the sheet postprocessing device 1, a stopper 95 is provided below the paper ejecting roller 44 for preventing the arm 89 from pivoting in the direction of F by more than a predetermined degree.

The light-shielding member 92 is formed into a plate, and a part of the side is fixed on the pivoting axis member 90 in a state in which the largest surface is placed vertically to the pivoting axis member 90. With this arrangement, the light-shielding member 92 is capable of moving in the direction of E-F together with the arm 89 through the pivoting axis member 90.

Figure 7:
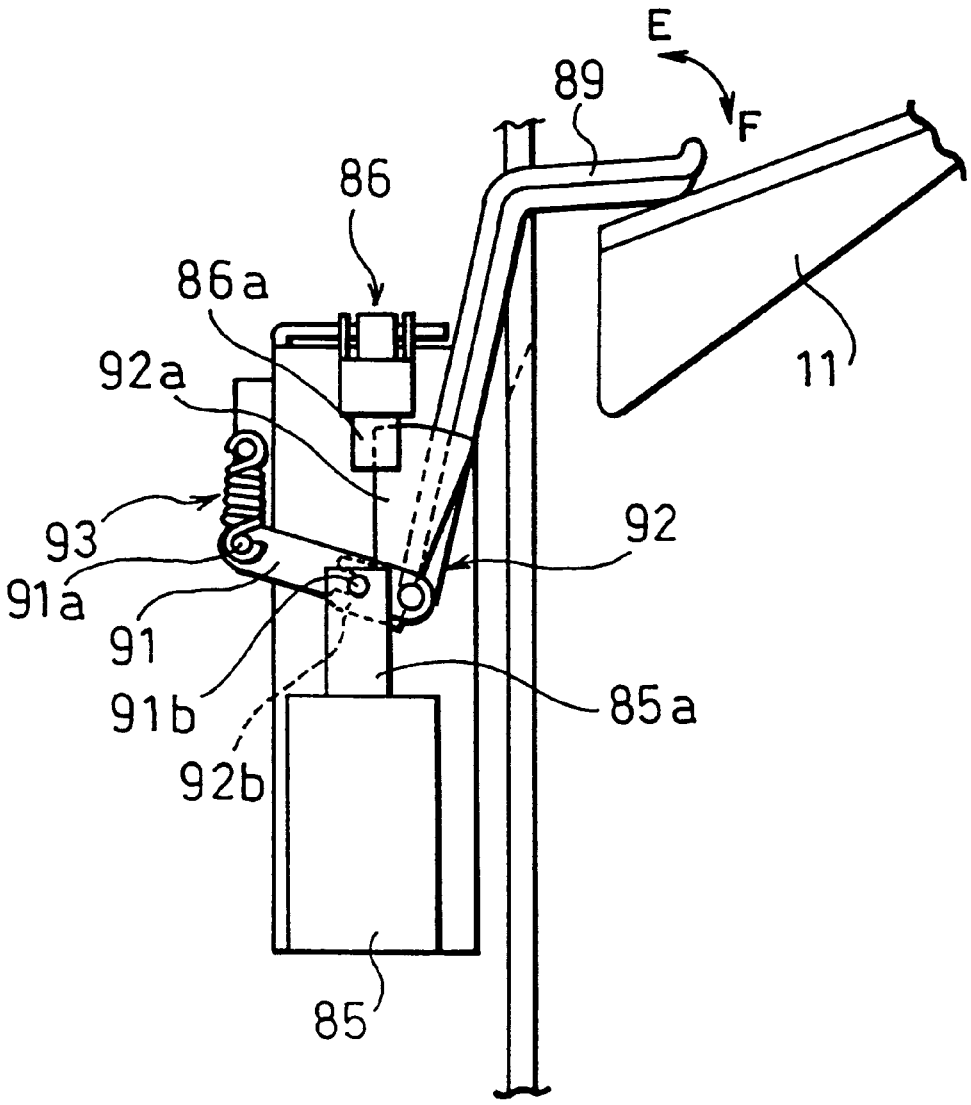
FIG. 7 is a sectional view which shows a construction of a main part of the sheet ejecting section.

As shown in FIG. 7, the light-shielding member 92 is provided with a fan member 92*a* which passes between the light-emitting member 86*a* and the light-receiving member 86*b* (shown in FIG. 8) of the upper limit sensor 86, mentioned below, in accordance with the pivoting movement of the arm 89. Further, when the arm 89 pivots between (including both ends) a sheet contact position and an arm shelter position(shelter position), the fan member 92*a* of the light-shielding member 92, which pivots with the arm 89, shields light of the light-emitting member 86*a*. When the arm 89 pivots through the sheet contact position and further pivots in the direction of F, the shield of the fan member 92*a* is removed from the light-emitting member 86*a*. Additionally, the sheet contact position indicates a position of the arm 89 where the contact portion 89*a* is in contact with the sheet P placed on the offset tray 11 so that the upper surface of the sheets P is detected, and the arm shelter position indicates a position where the arm 89 has pivoted in the direction of E so as not to interfere with the passage of the sheet P to be stacked on the offset tray 11.

Furthermore, the light-shielding member 92 is provided with a concave engaging member 92*b* which is engaged with the axis member 91*b* of the solenoid connecting member 91; therefore, the light-shielding member 92 is positively interlocked with a positional change of the axis member 91*b* of the solenoid connecting member 91 in accordance with a change of the solenoid top portion 85*a*.

Figure 8:
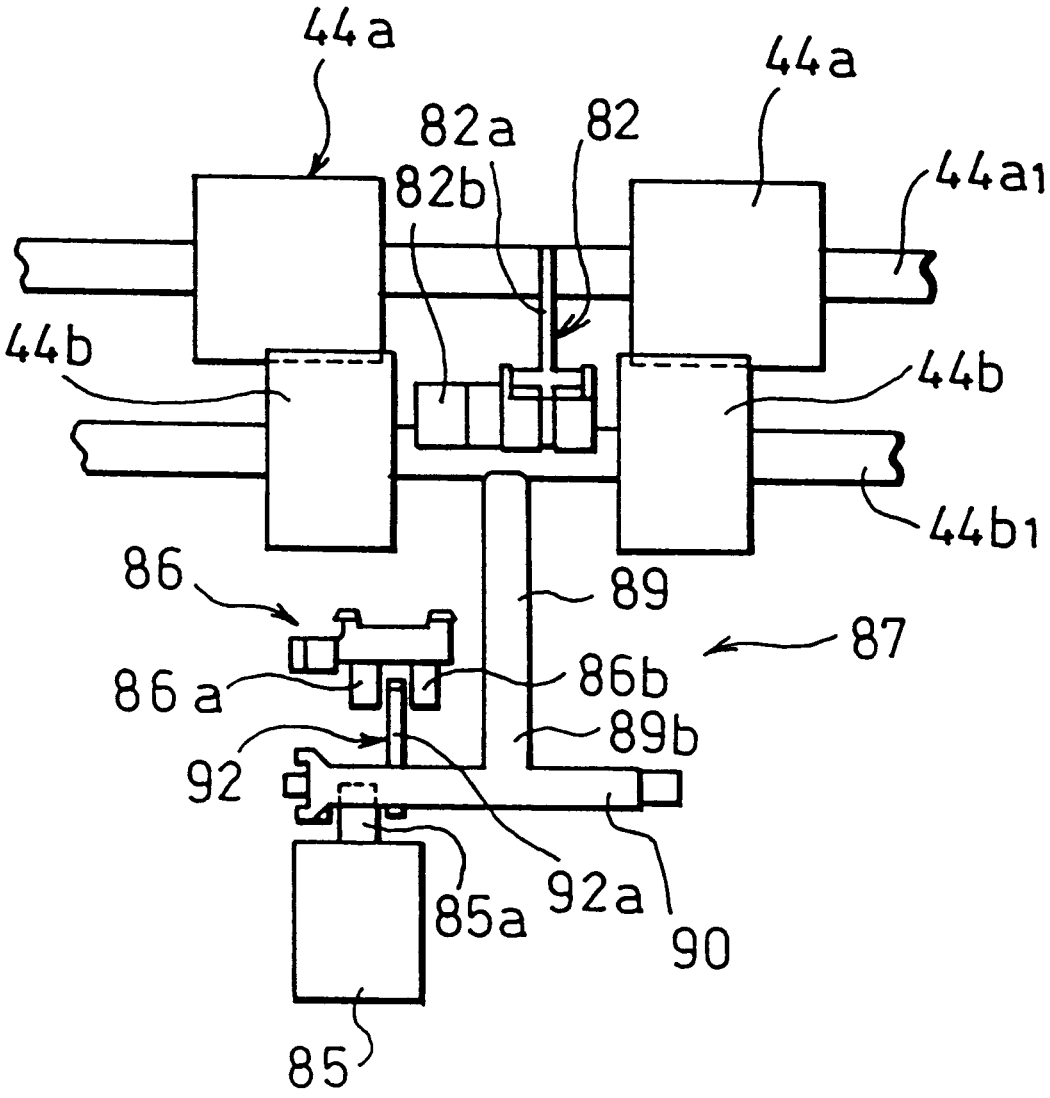
FIG. 8 is a side view from the sheet ejecting side of the sheet ejecting section.

As shown in FIG. 8, the upper limit sensor 86 is constituted by the light-emitting member 86*a* and the light-receiving member 86*b*. As mentioned above, the light-emitting member 86*a* is normally shielded by the light-shielding member 92 so that the light-receiving member 86*b* cannot receive light from the light-emitting member 86*a*. However, in the case when the rotation of the light-shielding member 92, which moves together with the arm 89, removes the shield on the light-emitting member 86*a* so that the light-receiving member 86*b* receives light from the light-emitting member 86*a*, the upper limit sensor 86 sends to the CPU 83 a signal indicating that the shield has been removed.

As mentioned above, the light-shielding member 92 moves together with the arm 89 so as to move the offset tray 11, thereby allowing the upper surface of the sheets P to be always set at a position regulated by the upper-surface position-regulating section 84.

Upon receiving the signal, the CPU 83 sends a signal to the ascending/descending device 50 to move the offset tray 11 upward. Further, the offset tray 11 ascends so that the upper surface of the sheets P contacts with the contact portion 89*a* of the arm 89, the arm 89 pivots in the direction of E, and the light-emitting member 86*a* is shielded again by the light-shielding member 92. Then, the detection signal from the upper limit sensor 86 allows the CPU 83 to send a signal to the ascending/descending device 50 so that the offset tray 11 stops ascending.

Additionally, as shown in FIG. 6, the sheet ejecting section 81 is provided with a tray lower limit sensor 88 for detecting the lower limit of the offset tray 11. When the tray lower limit sensor 88 detects the offset tray 11 reaching a descending limit, a detection signal is sent to the CPU 83, and allows the CPU 83 to recognize that the offset tray 11 is filled with the sheet P.

The following explanation describes the operation of the sheet ejecting section 81.

At an initial stage, as shown in FIG. 1, the arm 82*a* of the paper ejecting sensor 82 is placed on the sheet detecting position so as to positively contact with the transported sheet P. At this time, the solenoid 85 is turned off. Moreover, the arm 89 of the full-detecting actuator 87 is pressed in the direction of F by the pressing force of the spring 93. The pivoting axis member 90 serves as a supporting point. Therefore, when the sheet P is not stacked, the arm 89 is in contact with the upper surface of the offset tray 11 at the contact portion 89*a*. When the sheet P is stacked, the arm 89 is in contact with the upper surface of the sheets P at the contact portion 89*a*. Furthermore, at this time, the light-emitting member 86*a* of the upper limit sensor 86 is shielded by the light-shielding member 92.

Successively, when the sheet P is transported and contacts with the arm 82*a* of the paper ejecting sensor 82, as shown in FIG. 9, the arm 82*a* pivots in the direction of B by the transportation force of the sheet P. The pivot supporting point 82*c* serves as a supporting point.

At this time, the paper ejecting sensor 82 sends to the CPU 83 (shown in FIG. 6) a detection signal indicating the existence of the sheet P which is to be ejected. Upon receiving the detection signal, the CPU 83 sends a signal to the solenoid 85 so as to turn on the solenoid 85 and sends a signal to the ascending/descending device 50 so as to lower the offset tray 11 by a predetermined amount.

And then, the solenoid top portion 85*a* is pulled to the inside of the solenoid 85 (downward in FIG. 6); therefore, the solenoid connecting member 91, which is connected with the solenoid top portion 85*a* through the axis member 91*b*, pivots in the direction of H. The pivoting axis member 90 serves as a supporting point. At the same time, the arm 89 also pivots in the direction of E. The pivoting axis member 90 serves as a supporting point. With this arrangement, the arm 89 goes into a shelter state in which the arm 89 is not in contact with the sheet P ejected from the paper ejecting roller 44.

Moreover, at this time, the light-shielding member 92 pivots together with the arm 89; however, the light-emitting member 86*a* is still shielded by the light-shielding member 92.

Figure 10:
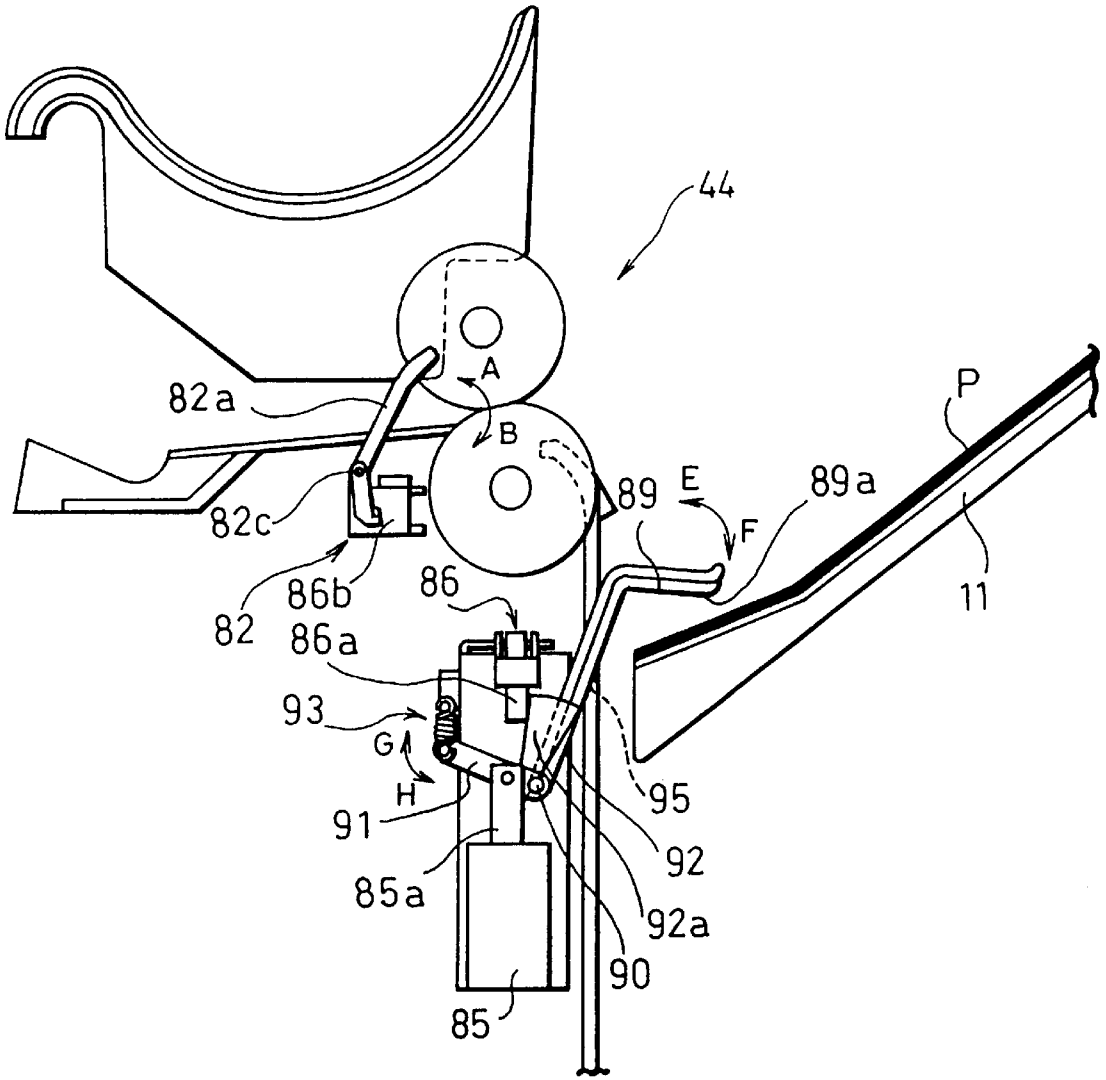
FIG. 10 is a sectional view which shows positions of the arm of the paper ejecting sensor and the arm of the full-detecting actuator just after a sheet has been ejected to an ascending/descending tray.

Successively, as shown in FIG. 10, when the rear portion of the sheet P passes through the top portion of the arm 82*a* and the arm 82*a* begins to pivot in the direction of A due to the pressing force of a spring (not shown), the paper ejecting sensor 82 sends to the CPU 83 a signal indicating the passage of the sheet P. Upon receiving this signal, the CPU 83 sends a signal so as to turn off the solenoid 85 after a predetermined time has passed. Additionally, the predetermined time is not particularly limited as long as it is not less than the time period needed from the time the sheet P passes through the top portion of the arm 82*a* until the time the sheet P is placed on the offset tray 11.

And then, the solenoid top portion 85*a*, which has been pulled into the inside, sticks out (upward in FIG. 10). This allows the connecting member 91 which is connected with the solenoid top portion 85*a* through the axis to pivot in the direction of G. The pivoting axis member 90 serves as a supporting point. At the same time, the arm 89 pivots in the direction of F with the pivoting axis member 90 serving as a supporting point.

At this time, since the offset tray 11 has descended a little from the initial state, the arm 89 pivots from the sheet contact position in the direction of F without contacting with the upper surface of the sheets P placed on the offset tray 11 at the contact portion 89*a*, and is supported by the stopper 95 that is attached to the inner surface of the sheet postprocessing device 1.

Hence, owing to the pivoting movement of the arm 89, the light-shielding member 92 moving together with the arm 89 has pivoted in the direction of F from the position of the initial state; therefore, the fan member 92*a* of the light-shielding member 92 moves out of the gap between the light-emitting member 86*a* and the light-receiving member 86*b* of the upper limit sensor 86. For this reason, the shield of the light-emitting member 86*a* is removed and the light-receiving member 86*b* receives light from the light-emitting member 86*a*. And then, the upper limit sensor 86 sends to the CPU 83 a signal indicating that the shield has been removed.

Figure 11:
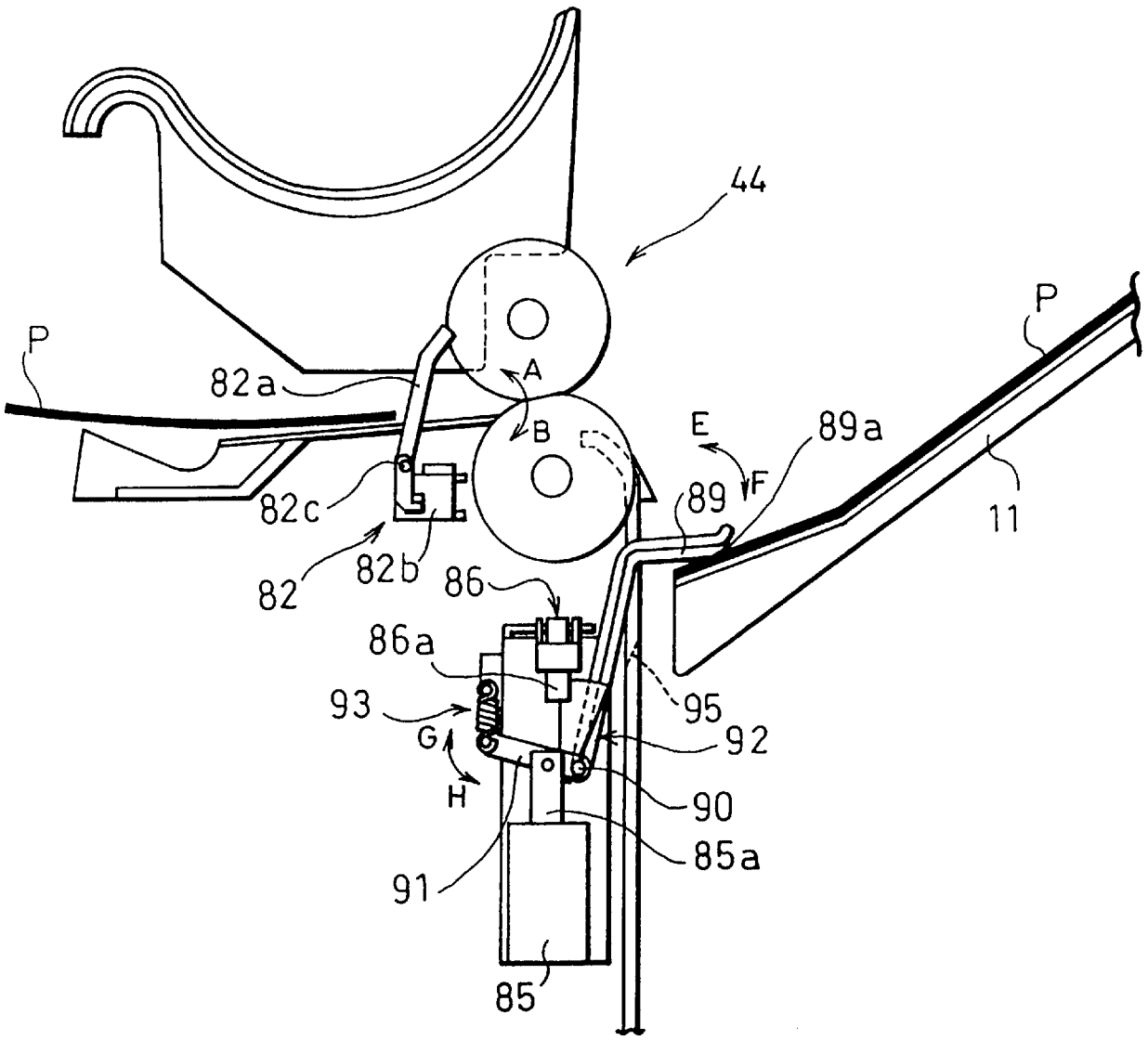
FIG. 11 is a sectional view which shows positions of the arm of the paper ejecting sensor and the arm of the full-detecting actuator when the sheet ejection to the ascending/descending tray is completed.
Figure 12:
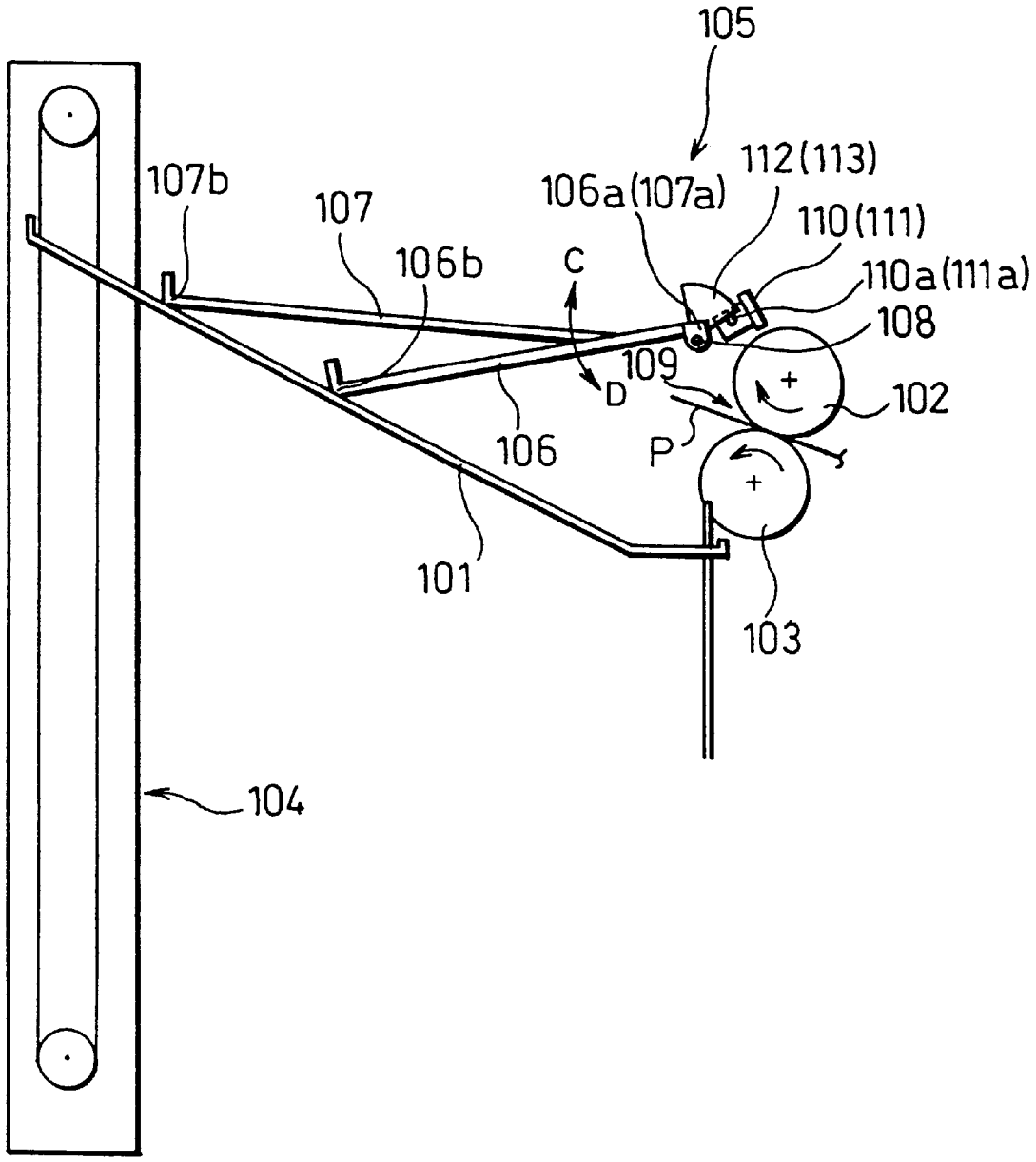
FIG. 12 PRIOR ART
FIG. 12 is a sectional view which shows a schematic construction of a conventional sheet postprocessing device.
Figure 13:
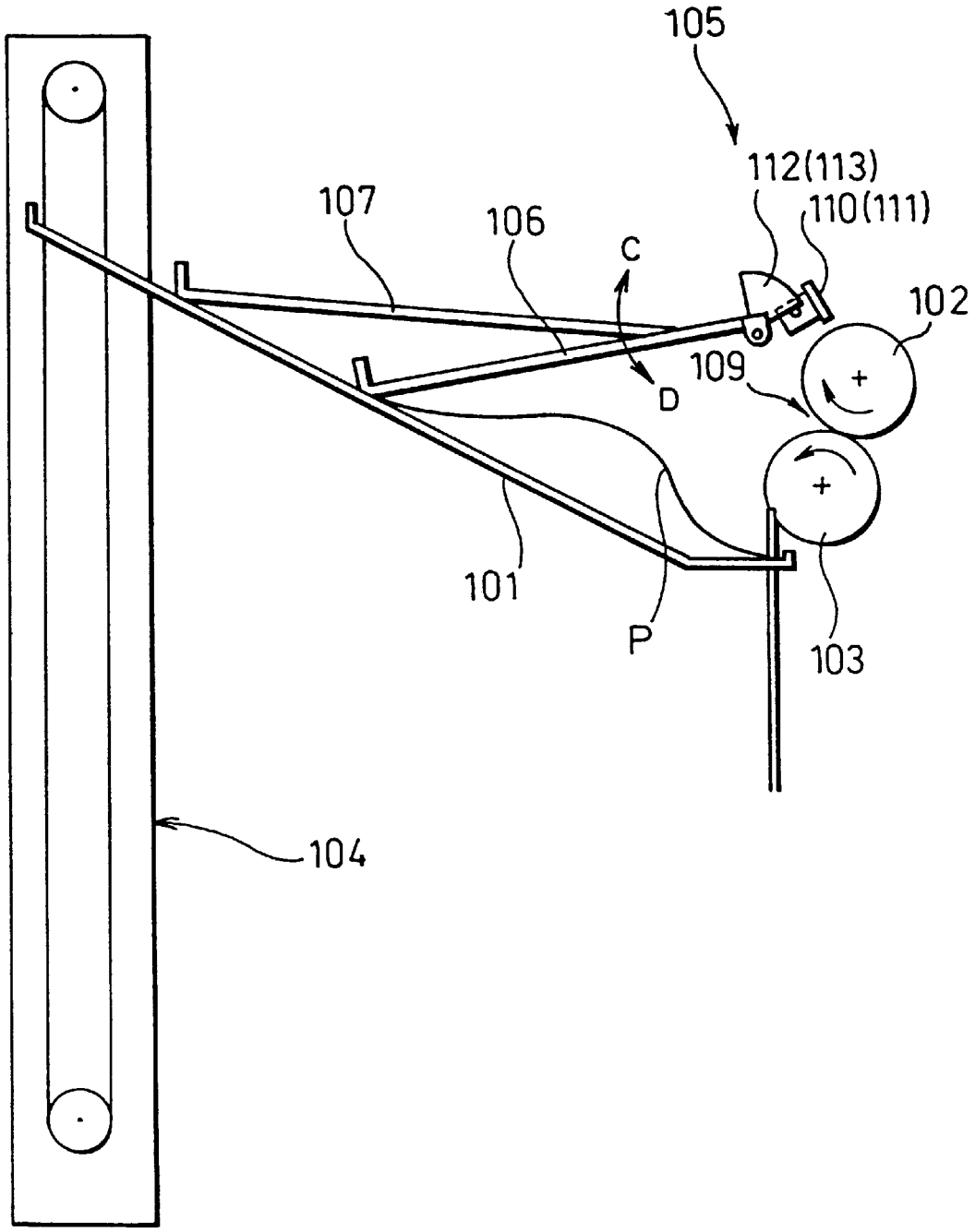
FIG.13 PRIOR ART
FIG. 13 is a sectional view showing a state in which a soft ejected sheet is warped.

Upon receiving this signal, the CPU 83 sends a signal to the ascending/descending device 50 so as to move the offset tray 11 upward. And then, as shown in FIG. 11, the ascending of the offset tray 11 allows the upper surface of the sheets P to come into contact with the contact portion 89*a* of the arm 89. Owing to succeeding ascending of the offset tray 11, the arm 89 makes a pivoting movement in the direction of E and the light-shielding member 92 also makes a pivoting movement in the direction of E.

When the pivoting movement of the light-shielding member 92 shields the light-emitting member 86*a* again, the CPU 83 sends a signal to the ascending/descending device 50 so as to stop the ascending of the offset tray 11 upon receiving the detection signal from the upper limit sensor 86. As a result, regardless of the number of the stacked sheets P, the offset tray 11 stops at a position where the upper surface of the sheets P stacked on the offset tray 11 is set at a predetermined position.

As the ejection of the sheet P is repeated and the sheets P are stacked on the offset tray 11, the position of the offset tray 11 gradually descends. Further, in the case when the tray lower limit sensor 88 detects the offset tray 11 reaching the lower limit after a temporarily descending, the tray lower limit sensor 88 sends a detection signal to the CPU 83. Upon receiving the detection signal, the CPU 83 recognizes that the offset tray 11 is not capable of descending at the next ejection and is filled with the sheets P at this time. And then, the CPU 83 sends a full-detection signal to, for example, a monitor section (not shown) of the copying machine 2 (shown in FIG. 2) and allows the operator to recognize the state by providing a display on the monitor.

As mentioned above, the upper-surface position-regulating section 84 does not always regulate the upper surface position of the sheets during the ejection of the sheets P. Only in the case when no sheet P is ejected, the upper-surface position-regulating section 84 allows the arm 89 to come into contact with the upper surface of the sheets P stacked on the offset tray 11 so as to regulate the upper surface position. Therefore, even in the case when a very soft sheet is used as the sheet P, it is possible to eject and stack the sheets P on the offset tray 11 without warping. This makes it possible to prevent the sheet P stacked on the offset tray 11 from having defects in stacking regardless of material of the sheet.

Additionally, in the present embodiment, for each detection signal from the paper ejecting sensor 82 in accordance with the passage of one sheet P, the CPU 83 controls the pivoting movement of the arm 89 and ascending/descending operations of the offset tray 11. However, since the thickness of one sheet P or one set of sheet P is not so large, the CPU 83 is allowed to control as follows: upon detection of the sheet P, the arm 89 is moved from the detecting position to the shelter position, a predetermined number of sheets (for example, 5 to 10 sheets) or a predetermined number of sets of sheet P are ejected, the arm 89 is moved from the shelter position to the detecting position, and then the arm 89 is allowed to come into contact with the sheet P or the offset tray 11 is allowed to descend.

Namely, in this case, when the paper ejecting sensor 82 detects the sheet P to be ejected, the CPU 83 turns on the solenoid 85 by sending a signal so as to allow the arm 89 to pivot in the direction of E. And then, after CPU 83 has recognized that the predetermined number of sheets or sets of the sheets P have passed between the arm 89 and the offset tray 11, upon receiving a detection signal from the paper ejecting sensor 82, the CPU 83 turns off the solenoid 85 by sending a signal thereto so as to allow the arm 89 to pivot in the direction of F, and sends a signal to the ascending/descending device 50 so as to lower the offset tray 11 by a predetermined amount. Successively, the CPU 83 drives the ascending/descending means 50 so that the offset tray 11 ascends until the upper surface of the last sheet P ejected onto the offset tray 11 reaches a position regulated by the upper-surface position-regulating section 84. The aforementioned control by the CPU 83 is surely capable of having the same effect as that of the present embodiment.

As described above, the upper-surface position-regulating means is favorably provided with: a position changing means for changing the position of the contact member so that the contact member separates from the upper surface of the sheets; and a control means for driving the position changing means so as to allow the contact member to separate from the upper surface of the sheets when the sheet detecting means detects a sheet to be ejected, and for driving the position changing means so as to allow the contact member to come into contact with the upper surface of the sheet newly ejected onto an ascending/descending tray when the sheet detecting means detects no sheet to be ejected.

With the aforementioned arrangement, the control means controls the driving of the position changing means in accordance with the result of the detection of the sheet detecting means indicating whether a sheet to be ejected exists or not. With this arrangement, in the case when the sheet to be ejected exists, the contact member separates from the upper surface of the sheets placed on the ascending/descending tray; on the other hand, in the case when no sheet to be ejected exists, the position changing means allows the contact member to come into contact with the upper surface of a sheet newly ejected onto the ascending/descending tray.

In other words, the contact member is not always in contact with the upper surface of ejected sheets on the ascending/descending tray. When a sheet to be ejected exists, the contact member temporarily separates from the upper surface of the sheets on the ascending/descending tray. And, when no sheet to be ejected exists, that is, after the sheet has been ejected to the ascending/descending tray, the contact member comes into contact with the upper surface of the sheets again. Therefore, when the ejected sheet is placed on the ascending/descending tray, the sheet is not in contact with the contact member. Consequently, even if the ejected sheet is very soft, the load of the contact member does not warp the sheet. Hence, with the aforementioned arrangement, even in the case when a very soft sheet is used, it is possible to eject and stack sheets on the ascending/descending tray without warping; therefore, it is possible to prevent the sheet P stacked on the ascending/descending tray from having defects in stacking regardless of material of the sheet.

Furthermore, it is desirable to have a construction in which the sheet ejecting device is further provided with an ascending/descending means for ascending and descending the ascending/descending tray, the upper-surface position-regulating means moves the ascending/descending tray downward by a predetermined amount after the sheet detecting means has detected the passage of a predetermined number of sheets or sets of sheets, and then the ascending/descending means is favorably driven so that the ascending/descending tray ascends until the upper surface of the sheets ejected to the ascending/descending tray reaches a position regulated by the upper-surface position-regulating means.

With the aforementioned arrangement, when the sheet detecting means detects a predetermined number of sheets or sets of sheets to be ejected, the ascending/descending tray descends by the ascending/descending means. Further, when a predetermined number of sheets or sets of sheets are ejected to the ascending/descending tray, the ascending/descending tray ascends until the upper surface of the sheets reaches a position regulated by the upper-surface position-regulating means. Consequently, regardless of the number of stacked sheets, it is possible to keep the position of the upper surface of the sheets at a predetermined position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet ejecting mechanism comprising:

sheet detecting means for detecting an existence of a sheet to be ejected onto an ascending/descending tray;

a contact member which separably contacts with an upper surface of ejected sheets on said ascending/descending tray;

upper-surface regulating means which moves said contact member to a contact position so that said contact member comes into contact with the upper surface of said ejected sheets in order to regulate a height of the upper surface of said ejected sheets when no sheet to be ejected exists and which also moves said contact member to a shelter position so that said contact member separates from the upper surface of said ejected sheets when a sheet to be ejected exists;

drive means for adjusting a height of said ascending/descending tray; and control means operatively configured to control said sheet detecting means, upper-surface regulating means and drive means in order that when a sheet to be ejected exists, said drive means first lowers said ascending/descending tray by a predetermined amount and said upper-surface regulating means moves said contact member from said contact position to said shelter position prior to said upper-surface regulating means moving said contact member back towards said contact position following ejection of said sheet to be ejected whereby said contact member does not return directly to said contact position in contact with said upper surface of said ejected sheets due to said drive means having previously lowered said ascending/descending tray.

2. The sheet ejecting mechanism as defined in claim 1, wherein said upper-surface regulating means comprises moving means for moving said contact member between said contact position of the upper surface of said ejected sheets and said shelter position which does not interfere with a passage of said ejected sheets, and said control means controls said moving means so that said contact member is moved to said contact position when no sheet to be ejected exists and so that said contact member is moved to said shelter position in the case when a sheet to be ejected exists, as well as controls ascending and descending of said ascending/descending tray so as to set the upper surface of said ejected sheets at a predetermined height in accordance with said contact position when said contact member is in contact with the upper surface of said ejected sheets.

3. The sheet ejecting mechanism as defined in claim 2, wherein when said sheet detecting means detects a predetermined number of sheets or sets of sheets to be ejected onto said ascending/descending tray, said control means controls ascending and descending of said ascending/descending tray so that the upper surface of ejected sheets is set at said predetermined height.

4. The sheet ejecting mechanism as defined in claim 1, wherein said sheet detecting means includes: an arm which is placed so as to freely pivot between first and second positions and starts to pivot to said second position when coming into contact with the sheet to be ejected onto said ascending/descending tray, and also pivots in an opposite direction to return to said first position when a passage of the sheet completed; and a sensor body which detects the sheet to be ejected onto said ascending/descending tray when said arm starts to pivot to said second position and which also detects no sheet to be ejected onto the ascending/descending tray when said arm starts to pivot to said first position.

5. The sheet ejecting mechanism as defined in claim 2, wherein:

said contact member includes an arm in which one end is in contact with the upper surface of said ejected sheets; and said moving means is provided with: a solenoid for turning on or off in accordance with a result of detection of said sheet detecting means, a pivoting axis member to which the other end of said arm is fixed so as to serve as a pivot supporting point of said arm, and a solenoid connecting member in which one end is fixed on said pivoting axis member and the other end is connected with an elastic member which presses said arm so as to come into contact with the upper surface of said ejecting sheets and which allows said solenoid to make a pivoting movement freely through the axis member in the vicinity of said pivoting axis member, wherein said arm is allowed to pivot between the upper surface of said ejected sheets and the shelter position which does not interfere with the passage of said ejected sheets, in accordance with turning on and off of said solenoid.

6. A sheet ejecting mechanism comprising:

sheet detecting means for detecting an existence of a sheet to be ejected onto an ascending/descending tray; and upper-surface position-regulating means including a contact member which is capable of moving, within a predetermined passage area, between a detecting position of an upper surface of sheets on the ascending/descending tray and a shelter position which is placed out of a passage area of the sheets stacked on the ascending/descending tray, wherein said upper-surface position-regulating means regulates the position of the upper surface of said sheets in accordance with a position of the contact member being located on said detecting position, moves said contact member from said detecting position to said shelter position when said sheet detecting means detects the sheet to be ejected, and moves said contact member from said shelter position to said detecting position when said sheet detecting means detects a predetermined number of sheets or sets of sheets have passed through the predetermined passage area of said contact member;

drive means for adjusting a height of said ascending/descending tray; and control means operatively configured to control said sheet detecting means, upper-surface position-regulating means and drive means in order that when a sheet to be ejected exists, said drive means first lowers said ascending/descending tray by a predetermined amount and said upper-surface position-regulating means moves said contact member from said detecting position to said shelter position prior to said upper-surface position-regulating means moving said contact member back towards said detecting position following ejection of said sheet to be ejected whereby said contact member does not return directly to said detecting position in contact with said upper surface of said ejected sheets due to said drive means having previously lowered said ascending/descending tray.

7. The sheet ejecting mechanism as defined in claim 6, wherein said upper-surface position-regulating means comprises position changing means for changing a position of said contact member so that said contact member separates from the upper surface of said sheets, and said control means drives said position changing means so that said contact member separates from the upper surface of said sheets when said sheet detecting means detects the sheet to be ejected, and drives said position changing means so that said contact member comes into contact with the upper surface of a sheet newly ejected onto the ascending/descending tray when said sheet detecting means detects no sheet to be ejected.

8. The sheet ejecting mechanism as defined in claim 6, wherein said control means allows the ascending/descending tray to descend by the predetermined amount after said sheet detecting means has detected that a predetermined number of sheets or sets of sheets have passed, and then, causes the ascending/descending tray to ascend until the upper surface of the sheets ejected onto the ascending/descending tray reaches a position regulated by the upper-surface position-regulating means.

9. The sheet ejecting mechanism as defined in claim 7, wherein said control means allows the ascending/descending tray to descend by the predetermined amount after said sheet detecting means has detected that a predetermined number of sheets or sets of sheets have passed, and then, causes the ascending/descending tray to ascend until the upper surface of the sheets ejected onto the ascending/descending tray reaches a position regulated by the upper-surface position-regulating means.

* * * * *